US006425801B1

(12) United States Patent
Takeishi et al.

(10) Patent No.: US 6,425,801 B1
(45) Date of Patent: Jul. 30, 2002

(54) POLISHING PROCESS MONITORING METHOD AND APPARATUS, ITS ENDPOINT DETECTION METHOD, AND POLISHING MACHINE USING SAME

(75) Inventors: Akira Takeishi; Hideo Mitsuhashi; Katsuhisa Ohkawa; Yoshihiro Hayashi; Takahiro Onodera, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/324,080

(22) Filed: Jun. 1, 1999

(30) Foreign Application Priority Data

Jun. 3, 1998 (JP) ..... 10-154221

(51) Int. Cl.[7] ..... B24B 1/00

(52) U.S. Cl. ..... 451/5; 451/6; 451/8; 451/41; 451/285; 451/287; 451/288; 364/474.06

(58) Field of Search ..... 451/5, 6, 8, 41, 451/285, 287, 288; 364/474.06

(56) References Cited

U.S. PATENT DOCUMENTS 5,953,115 A * 9/1999 Landers et al. ..... 356/237
5,993,289 A * 11/1999 Allen et al. ..... 451/5
6,100,985 A * 8/2000 Scheiner et al. ..... 356/381

FOREIGN PATENT DOCUMENTS

JP 23550 5/1995
JP 8-51090 2/1996
JP 09298175 A 11/1997
TW 76105617 9/1987

OTHER PUBLICATIONS

Japanese Office Action dated May 9, 2000 together with cited references: Unexamined Patent Applications (Kokai) Nos. 9–7985, 7–249599, and 5–309559; Prior Art Documents: Unexamined Patent Application Publications (Kokai) Nos. 8–174411, 7–251371, 9–119822, 7–235520 and 8–216016; English translation of material enclosed in wavy line.

* cited by examiner

*Primary Examiner*—Joseph J. Hail, III
*Assistant Examiner*—Shantse McDonald
(74) *Attorney, Agent, or Firm*—Michael Best & Friedrich LLC; J. Warren Whitesel

(57) ABSTRACT

A polishing process monitoring apparatus of a semiconductor wafer is provided, which is capable of monitoring correctly the process independent of various factors affecting optical measurement, such as the configuration, material, and size of a layered structure on the wafer, and the geometric shapes of patterns and their arrangement for respective semiconductor chips. This apparatus is comprised of (a) a light irradiating means for irradiating a detection light beam to a semiconductor wafer, (b) a first light receiving means for receiving a specular-reflected light beam generated by reflection of the detection light beam at the wafer and for outputting a first signal according to an amount of the specular-reflected light beam, (c) a second light receiving means for receiving a scattered/diffracted light beam generated by scattering or diffraction of the detection light beam at the wafer and for outputting a second signal according to an amount of the scattered/diffracted light beam, and (d) a monitoring means for monitoring a polishing process of the wafer by using the first and second signals.

34 Claims, 26 Drawing Sheets

POLISHING PROCESS MONITORING METHOD AND APPARATUS, ITS ENDPOINT DETECTION METHOD, AND POLISHING MACHINE USING SAME

BACKGROUND OF THE INVENTION

1. Field of the Invention

The present invention relates to a method and an apparatus of monitoring a polishing process of a semiconductor wafer, which are suitably applied to the well-known Chemical Mechanical Polishing (CMP) process, a method of detecting an endpoint of the polishing process, and a polishing machine equipped with the monitoring apparatus.

2. Description of the Prior Art

To form wiring or interconnecting lines, contact plugs penetrating via holes, and so on, for electronic devices or elements formed on a semiconductor wafer, conventionally, the so-called CMP process has been used. In this case, typically, a dielectric layer is formed on or over the entire wafer to cover the electronic devices or elements and then, a metal layer is formed to overlay the whole dielectric layer. Subsequently, an upper, unnecessary part of the metal layer is globally polished away by a polishing machine until the remaining metal layer has a desired pattern designed for the wiring lines, contact plugs, and so on.

It is important for the CMP process to be monitored for the purpose of detecting an optimum endpoint for the desired pattern at which the polishing operation is stopped. If the degree of polishing is insufficient, in other words, the polishing operation is stopped prematurely, the metal layer tends to be partially left on the underlying dielectric layer, causing electrical short circuit between the wiring lines and/or contact plugs. On the other hand, if the degree of polishing is excessive, in other words, the polishing operation is stopped belatedly, the remaining metal layer tends to have less cross-sections than those desired at the respective wiring lines and contact plugs.

The Japanese Non-Examined Patent Publication No. 7-235520 published in September 1995, which corresponds to the U.S. Pat. No. 5,433,651 issued on July 1995, discloses a technique for monitoring the polishing process of a semiconductor wafer. FIG. 1 shows schematically a prior art polishing process monitoring apparatus using the technique disclosed in the Japanese Non-Examined Patent Publication No. 7-235520.

In FIG. 1, the prior-art in-situ monitoring apparatus is equipped with a circular polishing table 102 rotatable in a horizontal plane, a polishing pad 103 placed on the surface of the table 102, a wafer holder 104 rotatable in a horizontal plane, a laser 106 as a light source for emitting a light beam 105, a photodiode 140 for receiving a reflected light beam 107, and a monitoring means 113. The table 102 has a viewing aperture 138 with a specific size, which allows the incident light beam 105 from the laser 106 to reach a semiconductor wafer or workpiece 101 held onto the bottom surface of the wafer holder 104. A view window 138*a* is fixed to the aperture 138 to prevent a polishing slurry 116 from flowing out through the aperture 138 while allowing the light beams 105 and 107 to penetrate.

The light beam 105 emitted from the laser 106 is irradiated to the polishing surface of the wafer 101, on which the beam 105 forms a beam spot having a specific diameter. The incident light beam 105 is reflected by the polishing surface of the wafer 101, forming the reflected light beam 107. The reflected light beam 107 is received by the photodiode 140.

The photodiode 140 measures the amount of the reflected light beam 107 and outputs an electric signal s to the monitoring means 113 according to the amount thus measured. The monitoring means 113 samples the electric signal s at specific time intervals to generate an electric detection signal through specific signal processing. Then, the monitoring means 113 displays a time-dependent change of the detection signal on a screen (not shown), in which the ordinate axis is defined as the amount of the detection signal and the abscissa axis as the polishing time.

Next, the operation of the prior-art in-situ monitoring apparatus shown in FIG. 1 is explained below.

The incident light beam 105 emitted from the laser 106 is irradiated through the viewing apertures 138 and 139 and the view window 138*a* to the polishing surface of the semiconductor wafer 101 held by the wafer holder 104. The irradiated light beam 105 is reflected by the polishing surface of the wafer 101, generating the reflected light beam 107. The reflected light beam 107 travels through the viewing apertures 138 and 139 and the view window 138*a* to be received by the photodiode 140, in which the amount of the beam 107 is measured and the electric detection signal s is generated according to the amount thus measured. The detection signal s from the photodiode is sampled and averaged in the monitoring means 113, displaying the time-dependent change of the signal s, i.e., the reflected light beam 107. The reflected light beam 107 is generated by "specular reflection" of the incident light beam 105.

During the time period from the start of polishing to the exposure of the underlying dielectric layer, the strength of the detection signal s, i.e., the amount of the reflected light beam 107, is kept approximately constant. This is because almost all the incident light beam 105 is specularly reflected by the metal layer having a comparatively high reflectance. When the underlying dielectric layer begins to be exposed from the metal layer due to the progressing polishing operation, a part of the incident light beam 105 is specularly reflected by the remaining metal layer and received by the photodiode 140. Thereafter, the amount of the reflected light beam 107 thus received gradually decreases with the progressing polishing operation because of the decreasing surface area of the remaining metal layer. At the same time as this, another part of the incident light beam 105 is specularly reflected by the structure formed below the dielectric layer and received by the photodiode 140. The remainder of the incident light beam 105 is scattered and/or diffracted by the remaining metal layer (i.e., the wiring lines and/or contact plugs) or the structure formed below the dielectric layer, which is not received by the photodiode 140. As a result, after the time the underlying dielectric layer begins to be exposed from the metal layer, the strength of the detection signal s, i.e., the amount of the reflected light beam 107, decreases gradually with time.

At the time when the polishing process reaches a desired endpoint, the dielectric layer is exposed from the remaining metal layer forming the desired wiring lines and/or contact plugs. At this stage, the amount of the reflected light beam 107 has a minimum value. After the time corresponding to the endpoint, the surface-area reduction of the metal layer is substantially zero even if the polishing process further progresses. Thus, the amount of the reflected light beam 107 has substantially a same value as that at the endpoint. In other words, the strength of the detection signal s is kept substantially constant after the corresponding time to the endpoint.

With the prior-art in-situ monitoring apparatus shown in FIG. 1, however, there is a problem that the polishing process may be unable to be monitored correctly according to the material of the semiconductor wafer 101, the thickness of the layered structure on the wafer 101, or the pattern (i.e., geometry or closeness/coarseness) of the wiring lines and/or contact plugs. This problem is due to the following reason.

For example, if the wafer 101 is made of a specific semiconductor material, the reflectance value of the metal layer may have a small difference from that of the underlying layered structure of the wafer 101. In this case, even if the surface area of the metal layer is decreased according to progress of the polishing process, the amount of the reflected light beam 107 (i.e., the strength of the detection signal s) varies only within a narrow range due to the small difference in reflectance. As a result, the endpoint of the polishing process is very difficult or unable to be detected correctly.

Additionally, the Japanese Non-Examined Patent Publication No. 8-174411 published in July 1996 discloses a similar technique to that shown in FIG. 1. In this technique, the amount of a specular-reflected light beam generated by the polishing surface of a semiconductor wafer is monitored during the polishing process. The endpoint of the polishing process is detected based on the change of the amount of a specular-reflected light beam during the process.

SUMMARY OF THE INVENTION

Accordingly, an object of the present invention to provide a method and an apparatus of monitoring a polishing process of a semiconductor wafer capable of monitoring correctly the process independent of various factors affecting optical measurement, such as the configuration, material, and size of a layered structure on the wafer, and the geometric shapes of patterns and their arrangement for respective semiconductor chips.

Another object of the present invention to provide an endpoint detection method capable of detecting correctly a desired endpoint of a polishing process of a semiconductor wafer.

Still another object of the present invention to provide a polishing machine capable of monitoring correctly a polishing process independent of various factors affecting optical measurement, such as the configuration, material, and size of a layered structure on the wafer, and the geometric shapes of patterns and their arrangement for respective semiconductor chips.

The above objects together with others not specifically mentioned will become clear to those skilled in the art from the following description.

According to a first aspect of the present invention, a polishing process monitoring apparatus is provided. This apparatus is comprised of (a) a light irradiating means for irradiating a detection light beam to a semiconductor wafer, (b) a first light receiving means for receiving a specular-reflected light beam generated by reflection of the detection light beam at the wafer and for outputting a first signal according to an amount of the specular-reflected light beam, (c) a second light receiving means for receiving a scattered/diffracted light beam generated by scattering or diffraction of the detection light beam at the wafer and for outputting a second signal according to an amount of the scattered/diffracted light beam, and (d) a monitoring means for monitoring a polishing process of the wafer by using the first and second signals.

With the polishing process monitoring apparatus according to the first aspect of the present invention, the first light receiving means outputs the first signal according to the amount of the specular-reflected light beam generated at the wafer and at the same time, the second light receiving means outputs the second signal representing the amount of the scattered/diffracted light beam at the wafer. Therefore, by using at least one of the time-dependent change of the amount of the specular-reflected light beam and that of the scattered/diffracted light beam, the polishing process can be monitored correctly independent of various factors affecting optical measurement, such as the configuration, material, and size of a layered structure on the wafer, and the geometric shapes of patterns and their arrangement for respective semiconductor chips.

According to a second aspect of the present invention, another polishing process monitoring apparatus is provided.

Unlike the apparatus according to the first aspect using the specular-reflected light and scattered/diffracted light beams, the apparatus according to the second aspect uses at least on detection light beam having different wavelengths from one another and at least one specular-reflected light beam. No scattered/diffracted light beam is used.

The polishing process monitoring apparats according to the second aspect is comprised of (a) a light irradiating means for irradiating at least one detection light beam having different wavelengths from one another to a semiconductor wafer, (b) a light receiving means for receiving at least one specular-reflected light beam generated by reflection of the at least one detection light beam at the wafer and for outputting a signal according to an amount of the at least one specular-reflected light beam, and (c) a monitoring means for monitoring a polishing process of the wafer by using the signal.

With the polishing process monitoring apparatus according to the second aspect of the present invention, since the at least one detection light beam having different wavelengths from one another and the at least one specular-reflected light beam are used, the polishing process can be monitored correctly independent on the above-described factors.

According to a third aspect of the present invention, still another polishing process monitoring apparatus is provided, which corresponds to one obtained by adding another light receiving means for receiving a scattered/diffracted light beam generated by scattering or diffraction of the at least one detection light beam at the wafer.

Specifically, the polishing process monitoring apparatus according to the third aspect is comprised of (a) a light irradiating means for irradiating at least one detection light beams having different wavelengths from one another to a semiconductor waver, (b) a first light receiving means for receiving at least one specular-reflected light beam generated by reflection of the at least one detection light beam at the wafer and for outputting a first signal according to an amount of the at least one specular-reflected light beam, (c) a second light receiving means for receiving a scattered/diffracted light beam generated by scattering or diffraction of the at least one detection light beam at the wafer and for outputting a second signal according to an amount of the scattered/diffracted light beam, and (d) a monitoring means for monitoring a polishing process of the wafer by using the first and second signals.

With the polishing process monitoring apparatus according to the third aspect of the present invention, because of the same reason as that shown in the apparatus according first or second aspect, the polishing process can be monitored correctly independent of the above-described factors.

According to a fourth aspect of the present invention, a further polishing process monitoring apparatus is provided.

Unlike the apparatuses according to the first to third aspects, the apparatus according to the fourth aspect includes a light condensing means for condensing a detection light beam.

Specifically, the apparatus according to the fourth aspect is comprised of (a) a light irradiating means for irradiating a detection light beam, (b) a light condensing means for condensing the detection light beam to form a condensed light beam having a spot size smaller than a specific pattern size on the wafer, the light condensing means being located on an optical axis of the detection light beam, (c) a light receiving means for receiving a specular-reflected light beam generated by reflection of the condensed light beam at the wafer and for outputting a signal according to an amount of the specular-reflected light beam, and (d) a monitoring means for monitoring a polishing process of the wafer by using the signal.

With the polishing process monitoring apparatus according to the fourth aspect of the present invention, because of the same reason as that shown in the apparatus according first or second aspect, the polishing process can be monitored correctly independent of the above-described factors.

Additionally, since the detection light beam is condensed prior to irradiation to the wafer, a scattered/diffracted light beam is likely to be generated, increasing the change of the amount of the scattered/diffracted light beam. Thus, there is an additional advantage that process monitoring by using the scattered/diffracted light beam is facilitated.

In the apparatus according to the fourth aspect, the light irradiating means may irradiate a plurality of detection light beams.

According to a fifth aspect of the present invention, a polishing process monitoring method is provided, which corresponds to the apparatus according to the first aspect of the present invention.

The method according to the fifth aspect is comprised of the steps of (a) irradiating a detection light beam to a semiconductor wafer, (b) receiving a specular-reflected light beam generated by reflection of the detection light beam at the wafer to output a first signal according to an amount of the specular-reflected light beam, (c) receiving a scattered/diffracted light beam generated by scattering or diffraction of the detection light beam at the wafer to output a second signal according to an amount of the scattered/diffracted light beam, and (d) processing the first and second signals to produce a resultant signal required for monitoring a polishing process of the wafer.

With the polishing process monitoring method according to the fifth aspect of the present invention, because of the same reason as shown in the polishing process monitoring apparatus according to the first aspect of the present invention, there is the same advantage as that of the apparatus according to the first aspect.

According to a sixth aspect of the present invention, another polishing process monitoring method is provided, which corresponds to the apparatus according to the second aspect of the present invention.

The method according to the sixth aspect is comprised of the steps of (a) irradiating at least one detection light beam having different wavelengths from one another to a semiconductor wafer, (b) receiving at least one specular-reflected light beam generated by reflection of the at least one detection light beam at the wafer and for outputting a signal according to an amount of the at least one specular-reflected light beam, and (c) processing the signal to produce a resultant signal required for monitoring a polishing process of the wafer.

According to a seventh aspect of the present invention, still another polishing process monitoring method is provided, which corresponds to the apparatus according to the third aspect of the present invention.

The method according to the seventh aspect is comprised of the steps of (a) irradiating at least one detection light beam having different wavelengths from one another to a semiconductor wafer, (b) receiving at least one specular-reflected light beam generated by reflection of the at least one detection light beam at the wafer and for outputting a first signal according to an amount of the at least one specular-reflected light beam, (c) receiving a scattered/diffracted light beam generated by scattering or diffraction of the at least one detection light beam at the wafer and for outputting a second signal according to an amount of the scattered/diffracted light beam, and (d) processing the first and second signals to produce a resultant signal required for monitoring a polishing process of the wafer.

According to an eighth aspect of the present invention, a further polishing process monitoring method is provided, which corresponds to the apparatus according to the fourth aspect of the present invention.

The method according to the eighth aspect is comprised of the steps of (a) irradiating a detection light beam, (b) condensing the detection light beam to form a condensed light beam having a spot size smaller than a specific pattern size on the wafer, the light condensing means being located on an optical axis of the detection light beam, (c) receiving a specular-reflected light beam generated by reflection of the condensed light beam at the wafer and for outputting a signal according to an amount of the specular-reflected light beam, and (d) processing the signal to produce a resultant signal required for monitoring a polishing process to the wafer.

In the method according to the eighth aspect, a plurality of detection light beams may be used.

At least two ones of the polishing process monitoring methods according to the fifth to eighth aspects may be combined together as necessary.

In the polishing process monitoring apparatus and methods according to the first to eighth aspects of the present invention, as the detection light beam, any coherent light beam generated by a laser may be preferably used. However, any incoherent light beam generated by a Light-Emitting Diode (LED), halogen lamp, or the like may be used.

The detection light beam may be irradiated to any position of the polishing surface of the wafer if it is always exposed. If the position to be irradiated is located near the center of the wafer, the detection light beam may be screened by the moving polisher. In this case, therefore, the momentary location and the timing of the polisher need to be detected by a position sensor or the like to detect a reflected light beam only when the detection light beam is reflected by the wafer, not by the polisher.

To average the effect of closeness and coarseness of the patterns in each of Integrated Circuit (IC) chips contained in the wafer, the diameter of the detection light beam is preferably set in such a way as to have a spot size equal to or greater than the size of the chips contained in the wafer. However, if the above-described effect of closeness and coarseness of the patterns can be decreased sufficiently by averaging the first signal (or the first and second signals) during a single rotation of the wafer, the spot size of the detection light beam may be less than the chip size. When the spot size of the detection light beam is less than the chip size, the irradiated position of the wafer may be scanned or switched to average the above-described effect of closeness and coarseness of the patterns.

The detection light beam and the light receiving face of each light receiving means may have any shape, such as circle, rectangular, and so on.

A plurality of detection light beams having different wavelengths may be irradiated along the same optical axis to the wafer. In this case, the detection light beams produce the specular-reflected light beams and the scattered/diffracted light beams, which are separated by a spectrum analyzer to be inputted into the monitoring means. Thus, a first set of signals corresponding to the amount of the specular-reflected light beams and a second set of signals corresponding to the amount of the scattered/diffracted beams are generated. Monitoring of a polishing process of the wafer is carried out by using the first and second sets of signals.

As the spectrum analyzer, a wavelength-selecting filter, a wavelength-selecting mirror, or a diffraction grating may be preferably used.

To realize a plurality of detection light beams having different wavelengths, a plurality of lasers oscillating at a single wavelength typically used. However, a multi-line laser capable of oscillating at different wavelengths may be used. In this case, a single light bean containing different wavelengths is produced.

The detection light beam may be condensed by an optical condensing means to a specific pattern size and irradiated to the wafer.

The specular-reflected light beam may be directly received by the first light receiving means. It may be indirectly received by the first light receiving means through a mirror or the like.

The scattered/diffracted light beam may be condensed by an ellipsoidal mirror located on the optical axis of the specular-reflected light beam. The size of the light-receiving face for the scattered/diffracted light beam is preferably wider than that for the specular-reflected light beam. The light receiving face for the scattered/diffracted light beam is preferably located on the optical axis of the specular-reflected light beam at a downstream position with respect to the light receiving or reflecting means for the specular-reflected light beam.

As the light receiving means for the specular-reflected light beam and/or the scattered/diffracted light beam, any light receiving element such as a photodiode, and a photomultiplier may be used.

To remove selectively the polishing slurry from the detection area of the wafer to thereby form a window in the slurry, allowing the specular-reflected light beam to be formed from the detection light beam, preferably, any fluid (i.e., gas or liquid) is emitted to a specific location of the wafer at a specific speed and a specific flowing rate. Although the emitted fluid is typically directed to a position for forming the window of the slurry, it may be directed to another position apart from the position (i.e., detection area) for the window by a specific distance in a specific direction.

To emit the fluid for forming the detection window in the slurry, a nozzle is preferably provided. However, the nozzle may be omitted if the rotation speed of the wafer is high enough for the slurry to be fully spread and to be sufficiently thin on the whole wafer due to the centrifugal force, applying no effect to detection of the specular-reflected light beam.

The position and angle of the nozzle and the fluid pressure emitted from the nozzle are optionally set if they apply no effect to monitoring of the polishing process. If the supply rate of the slurry onto the wafer is greater than the spreading rate of the slurry for forming the window on the wafer due to the high rotation speed of the wafer, the nozzle is preferably located at an upstream position with respect to the window.

An endpoint of the polishing process may be detected by the monitoring means of the apparatus according to one of the first to fourth aspects in any way, some preferred examples of which are explained below.

(i) After a mean or average value of the amount of each of the specular-reflected and scattered/diffracted light beams during a specific time period is calculated, the mean value is compared with a specific threshold value. Then, the time when at least one of the mean values of the two light beams is higher or lower than their threshold values is determined as an endpoint of the polishing process.

(ii) A mean or average value of the amount of each of the specular-reflected and scattered/diffracted light beams during a specific time period is calculated. On the other hand, a mean or average value of the amount of each of the specular-reflected and scattered/diffracted light beams during a specific time period after a specific time period has been passed from the start of the polishing process is calculated. Then, differences or ratios between the two means values are calculated for the specular-reflected and scattered/diffracted light beams and then, the differences or ratios thus calculated are compared with their specific threshold values. Finally, the time when at least one of the differences or ratios of the two light beams is higher or lower than their threshold values is determined as an endpoint of the polishing process.

(iii) After a mean or average value of the amount of each of the specular-reflected and scattered/diffracted light beams during a specific time period is calculated, the mean value is differentiated by time. The absolute value of the time-differentiated value is compared with a specific threshold value. Then, the time when at least one of the absolute values of the two light beams is lower than their threshold values is determined as an endpoint of the polishing process. Instead of the time-differentiated values, the change of the mean values may be used.

(iv) After a maximum value of the amount of each of the specular-reflected and scattered/diffracted light beams during a specific time period is calculated, the maximum value is compared with a specific threshold value. Then, the time when at least one of the maximum values of the two light beams is higher or lower than their threshold values is determined as an endpoint of the polishing process.

(x) After an amplitude (i.e., the difference between a maximum value and a minimum value) of the amount of each of the specular-reflected and scattered/diffracted light beams during a specific time period is calculated, the amplitude is compared with a specific threshold value. Then, the time when at least one of the amplitudes of the two light beams is higher than their threshold values is determined as an endpoint of the polishing process.

(xi) After a dispersion of the amount of each of the specular-reflected and scattered/diffracted light beams during a specific time period is calculated, the dispersion is compared with a specific threshold value. Then, the time when at least one of the dispersions of the two light beams is higher than their threshold values is determined as an endpoint of the polishing process.

(xii) After a mean or average value of the amount of each of the specular-reflected light beam or beams having different wavelengths and the scattered/diffracted light beam or beams having different wavelengths during a specific time period is calculated, the mean value is compared with a specific threshold value. Then, the time when at least one of the mean values of the two light beams having different wavelengths is higher or lower than their threshold values is determined as an endpoint of the polishing process.

(xiii) A mean or average value of the amount of each of the specular-reflected light beams having different wavelengths during a specific time period is calculated. On the other hand, a mean or average value of the amount of each of the specular-reflected light beams having different wavelengths during another specific time period after a specific time period has been passed from the start of the polishing process is calculated. Then, a difference or ratio between the two mean values is calculated for each of the specular-reflected light beams and then, the difference or ratio thus calculated is compared with a specific threshold value. Finally, the time when at least one of the differences or ratios of the light beams is higher or lower than their threshold values is determined as an endpoint of the polishing process.

(ix) After a maximum value and a mean value of the amount of the specular-reflected light beam during a specific time period are calculated, a difference or ratio between the maximum value and the mean value is calculated. Then, the difference or ratio is compared with a specific threshold value. Finally, the time when the difference or ratio is higher or lower than the threshold value is determined as an endpoint of the polishing process. This is preferred for the case where the detection light beam has a size equal to or less than a specific beam size of the detection light beam is condensed to have a spot size equal to or less than a specific size.

In addition, a difference or ratio of the scattered/diffracted light beam is calculated in the same way as that of the specular-reflected light beam and then, it is compared with a specific threshold value. Subsequently, an endpoint of the polishing process may be determined based on the comparison results for the specular-reflected and scattered/diffracted light beams.

(x) After a mean or average value of the amount of each of the specular-reflected and scattered/diffracted light beams during each of specific time periods is calculated, a variation between maximum and minimum values of the mean values during specific preceding time periods is calculated. Then, the variation of each beam is compared with a specific threshold value. Finally, the time when at least one of the variations of the two beams is higher or lower than the threshold value is determined as an endpoint of the polishing process.

(xi) In the above-described methods (i) to (x), instead of the value or values during each specific time period to be compared with the corresponding threshold value or values, a mean value or values during specific preceding time periods is/are used.

(xii) In the above-described methods (i) to (x), an endpoint is determined as the time when at least one of the values is higher or lower than the threshold value during specific consecutive time periods.

(xiii) In the above-described methods (i) to (x), an endpoint is determined by using the changing state or behavior of each of the values.

(xiv) In the above-described methods (i) to (x), an endpoint is determined as a time delayed by a specific time period from the time when at lest one of the values is higher or lower than the threshold value during a specific time period or specific consecutive timer periods.

(xv) In the above-described methods (i) to (x), instead of the value or values during each specific time period to be compared with the corresponding threshold value or values, a mean value or values during specific preceding or consecutive time periods is/are compared with the corresponding threshold values. Then, an endpoint is determined as a time delayed by a specific time period from the time when at least one of the mean values is higher or lower than the corresponding threshold value.

(xvi) At least two ones of the above-described methods (i) to (xv) are selected and combined together as a logical addition or logical multiplication, thereby determining an endpoint.

(xvii) In the above-described methods (i) to (xvi), an endpoint is determined as the time when the measured or calculated value or values is equal to or greater or less than the corresponding threshold value or values.

According to a ninth aspect of the present invention, a polishing machine is provided, which is comprised of a polishing means for polishing a polishing surface of the semiconductor wafer, and one of the polishing process monitoring apparatuses according to the first to fourth aspects of the present invention.

In the machine according to the ninth aspect, it is preferred that the polishing surface of the wafer faces upward. However, the surface may face any orientation if an optical path (or paths) for detecting the specular-reflected light beam (and for the scattered/diffracted light beam) is (are) formed.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
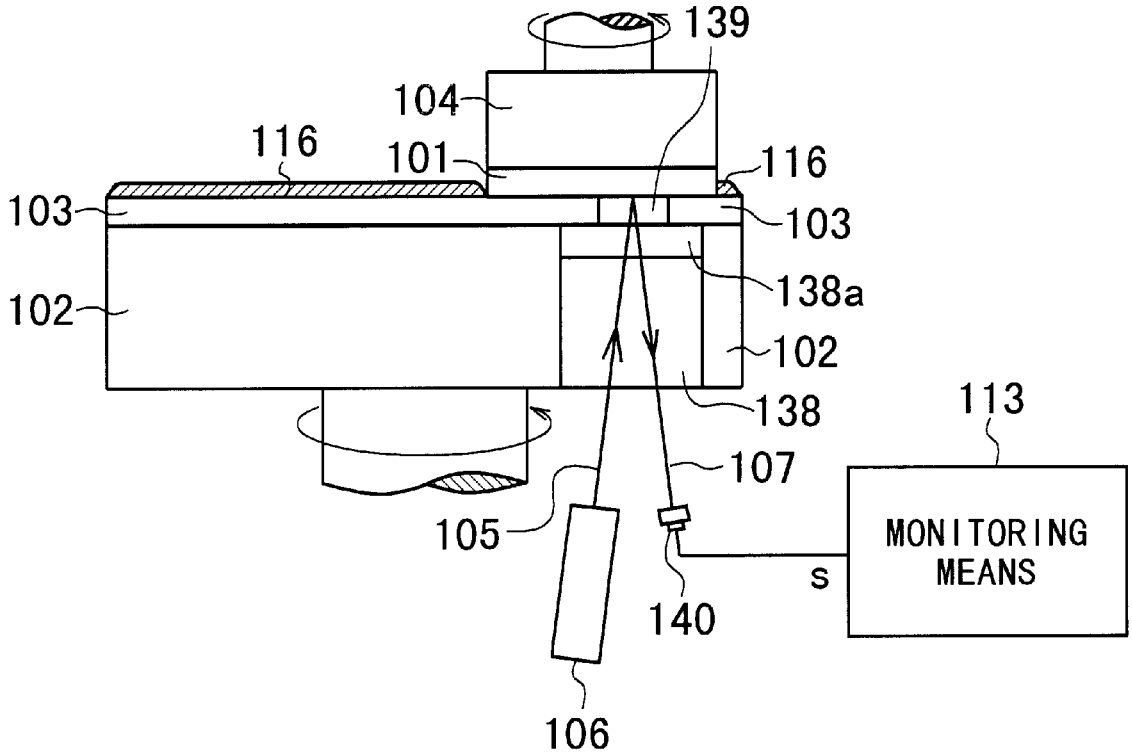
FIG. 1 PRIOR ART
FIG. 1 is a schematic illustration showing the configuration of a polishing machine equipped with a prior-art polishing process monitoring apparatus.

Preferred embodiments of the present invention will be described in detail below while referring to the drawings attached.

FIRST EMBODIMENT

Figure 2:
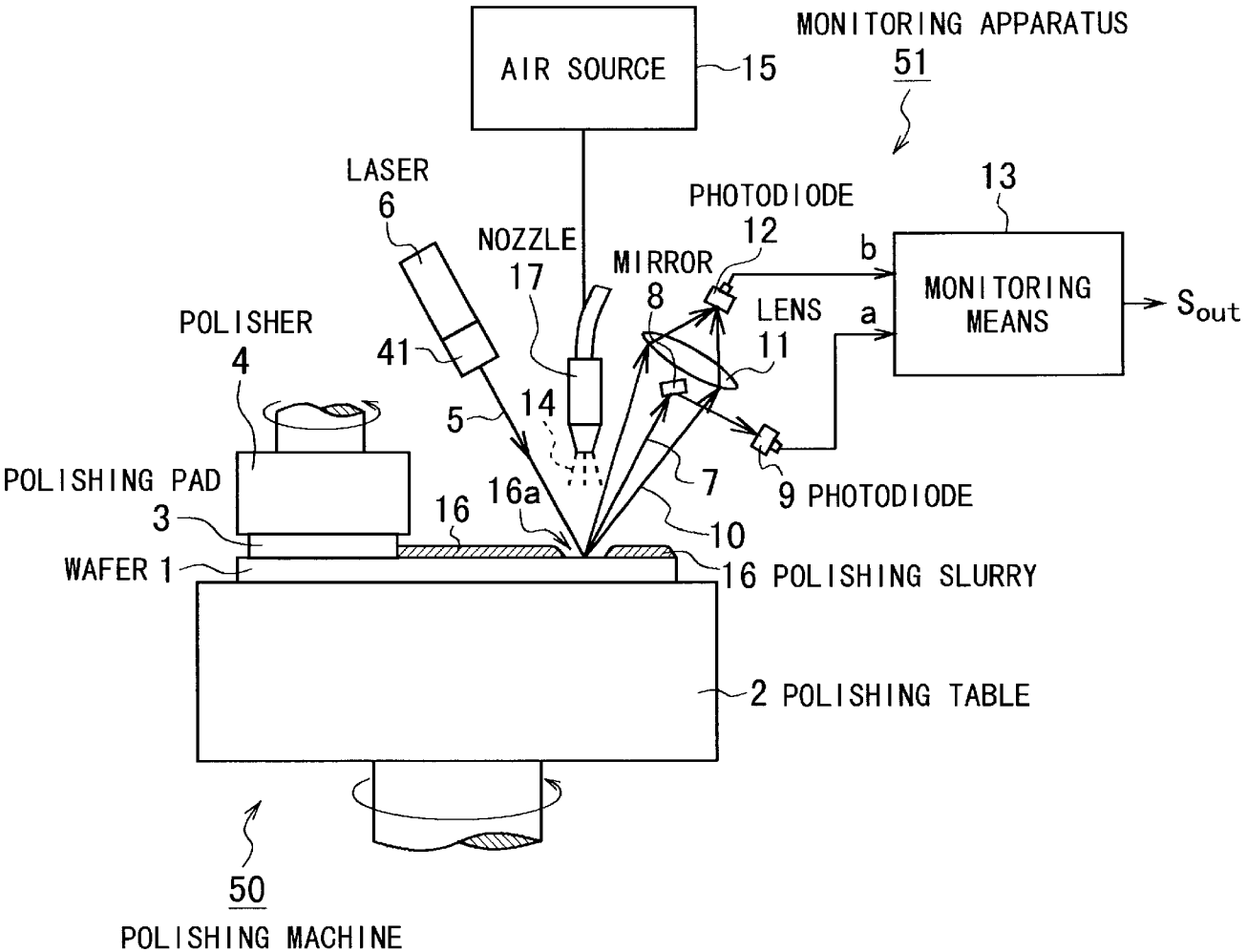
FIG. 2 is a schematic illustration showing the configuration of a polishing machine equipped with a polishing process monitoring apparatus according to a first embodiment of the present invention, in which a single detection light beam and specular-reflected and scattered/diffracted light beams are used.

As shown in FIG. 2, a polishing machine 50 is equipped with a circular polishing table 2, a polisher 4, and a monitoring apparatus 51 according to a first embodiment of the present invention. This machine 50 is used to carry out a CMP process of a semiconductor wafer 1.

The table 2, which is rotatable in a horizontal plane around a vertical axis, holes a semiconductor wafer 1 on its top face. The wafer 1 held on the top face of the table 2 is rotated along with the table 2 on operation. The polisher 4 is rotatable in a horizontal plane around a vertical axis and is slidable off the same vertical axis in the same horizontal plane. The polisher has a polishing pad 3 attached onto its bottom face. On operation, the pad 3 on the rotating polisher 4 is contacted with the upper surface (i.e., the polishing surface) of the wafer 1 under a specific pressure while being moved along the surface of the wafer 1.

The monitoring apparatus 51, which monitors in situ the polishing process or polished state of the wafer 1, is comprised of a laser 6, a detection-light irradiator or controller 41, a mirror 8, a first photodiode 9, a condensing lens 11, a second photodiode 12, a monitoring means 13, an air source 15, and an air nozzle 17.

The laser 6 serves as a light source for a detection light beam 5. The detection-light irradiator 41 irradiates the light generated by the laser 6 as the detection light beam 5 toward a specific location on the polishing surface of the wafer 1 so that the beam 5 forms a specific angle with respect to the polishing surface and a spot of a specific diameter on the same polishing surface.

The mirror 8, which is located on the optical axis of the specular-reflected light beam 7 and has a specified diameter, reflects a specular-reflected light beam 7 generated by specular or mirror-like reflection of the detection light beam 5 at the surface of the wafer 1 and sends the specular-reflection light beam 7 thus reflected to the first photodiode 9.

The first photodiode 9 serves as a light receiver and is located on the near-side of the condensing lens 11 with respect to the wafer 1. The photodiode 9 receives the specular-reflected light beam 7 and measures its amount, outputting a first electric signal a according to the measured amount of the specular-reflected light beam 7 to the monitoring means 13.

The condensing lens 11 is located on the optical axis of the specular-reflected light beam 7 between the mirror 8 and the second photodiode 12. The lens 11 condenses a scattered/diffracted light beam 10 generated by scattering and/or diffraction of the detection light beam 5 at the surface of the wafer 1 and sends the scattered/diffracted light beam 10 thus condensed to the second photodiode 12.

The second photodiode 12 serves as a light receiver and is located on the far-side of the condensing lens 11 with respect to the wafer 1. The photodiode 12 receives the scattered/diffracted light beam 10 and measures its amount, outputting a second electric signal b according to the measured amount of the scattered/diffracted light beam 10 to the monitoring means 13.

The monitoring means 13 receives the first and second electric signals a and b and monitors the progress of the polishing process or polished state of the wafer 1 through a specific signal processing method using the signals a and b. The means 13 further detects a desired endpoint of the polishing process.

The nozzle 17 emits the air supplied from an air source 15 toward the wafer 1, forming an air beam 14 with a specific flow rate. The air beam 14 applies a specific pressure to an area of the polishing surface of the wafer 1 and removes partially a polishing slurry 16 covering the same polishing surface, forming a window 16*a* of the slurry 16 at the area to which the air beam 14 is blown. In the window 16*a* thus formed, the polishing surface of the wafer 1 is almost exposed from the slurry 16, forming a detection area on the polishing surface.

Next, the operation of the polishing machine 50 is explained below.

Figure 3A:
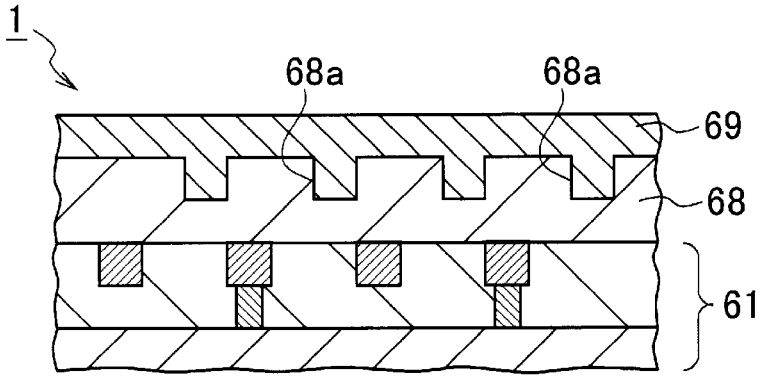
FIGS. 3A to 3D are schematic partial cross-sectional views of a semiconductor wafer, which show the polishing process steps of a metal layer to form wiring lines in an underlying dielectric layer, respectively.

FIG. 3A shows a partial cross-sectional view of the semiconductor wafer 1 prior to start of the polishing operation. In FIG. 3A, a dielectric layer 68, which is formed on an underlying layered structure 61, has trenches 68*a* for metallic wiring lines. A metal layer 69 is formed on the dielectric layer 68 to fill the whole trenches 68*a*. The layered structure 61, the dielectric layer 68, and the metal layer 69 extend over the whole wafer 1.

Figure 3B:
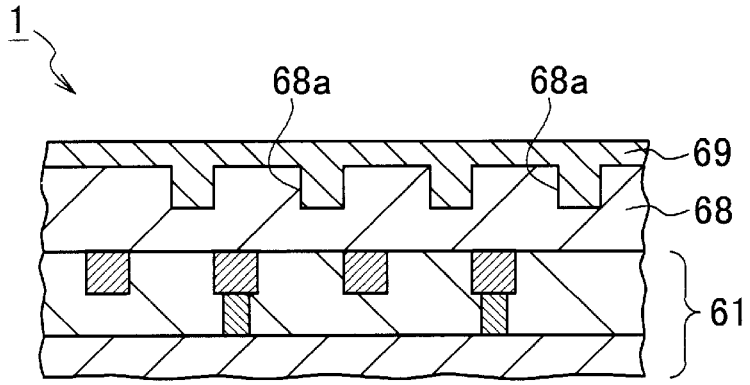

FIG. 3B shows the state of the wafer 1 on the way of the polishing process, in which the top part of the metal layer 69 is uniformly removed by polishing and the dielectric layer 68 is not exposed from the metal layer 69.

Figure 3C:
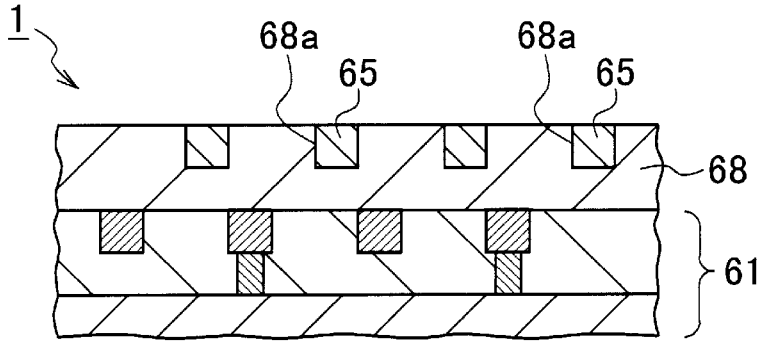

FIG. 3C shows the state of the wafer 1 after the polishing process is suitably or correctly ended, in which the unnecessary part of the metal layer 69 existing over the dielectric layer 68 is entirely removed by polishing, thereby forming metallic wiring lines 65 in the trenches 68*a*.

Figure 3D:
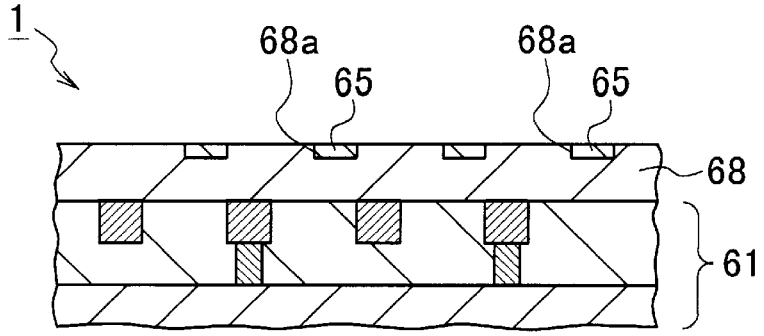

FIG. 3D shows the state of the wafer 1 after excessive polishing, in which the thickness of the remaining metal layer 60 (i.e., the cross section of the wiring lines 65) is less than that desired.

To form the metallic wiring lines 65 in the dielectric layer 68 by the CMP process, first, as shown in FIG. 2, the wafer, 1 is placed and fixed on the top surface of the polishing table 2 and then, the table 2 is rotated around its vertical axis at a specific rate. Then, the polishing slurry 16 is dropped onto the upper surface (i.e., the metal layer 69) of the wafer 1. The slurry 16 is uniformly coated to cover the whole surface of the wafer 1 or the metal layer 69 due to a centrifugal force.

On the other hand, the polisher 4 having the polishing pad 3 and being rotated around its vertical axis is lowered toward the wafer 1 until the pad 3 is contacted with the polishing surface of the wafer 1 (i.e., the metal layer 69). The rotating polisher 4 is pressed to the wafer 1 at a specific pressure and moved along the surface of the wafer 1 to ensure the polishing action to be applied to the whole wafer 1.

In this case, the polishing process needs to be correctly monitored and at the same time, the endpoint of this process needs to be detected correctly. If the polishing operation to the metal layer 69 is stopped prematurely, the metal layer 69 is left not only in the trenches 68*a* but also on the dielectric layer 68, as shown in FIG. 3B, causing electrical short circuit between the resultant wiring lines 65. On the other hand, if the degree of polishing is excessive, in other words, the polishing operation to the metal layer 69 is stopped belatedly, the remaining metal layer 69 (i.e., the wiring lines 65) tends to have less cross-sections than those desired at the respective wiring lines 65, as shown in FIG. 3D. Moreover, some steps tend to be formed between the wiring lines 65 and the remaining dielectric layer 68 due to difference of their polishing rates.

To ensure correct endpoint detection of the above-described polishing process, the monitoring apparatus 51 according to the first embodiment operates in the following way.

Figure 11:
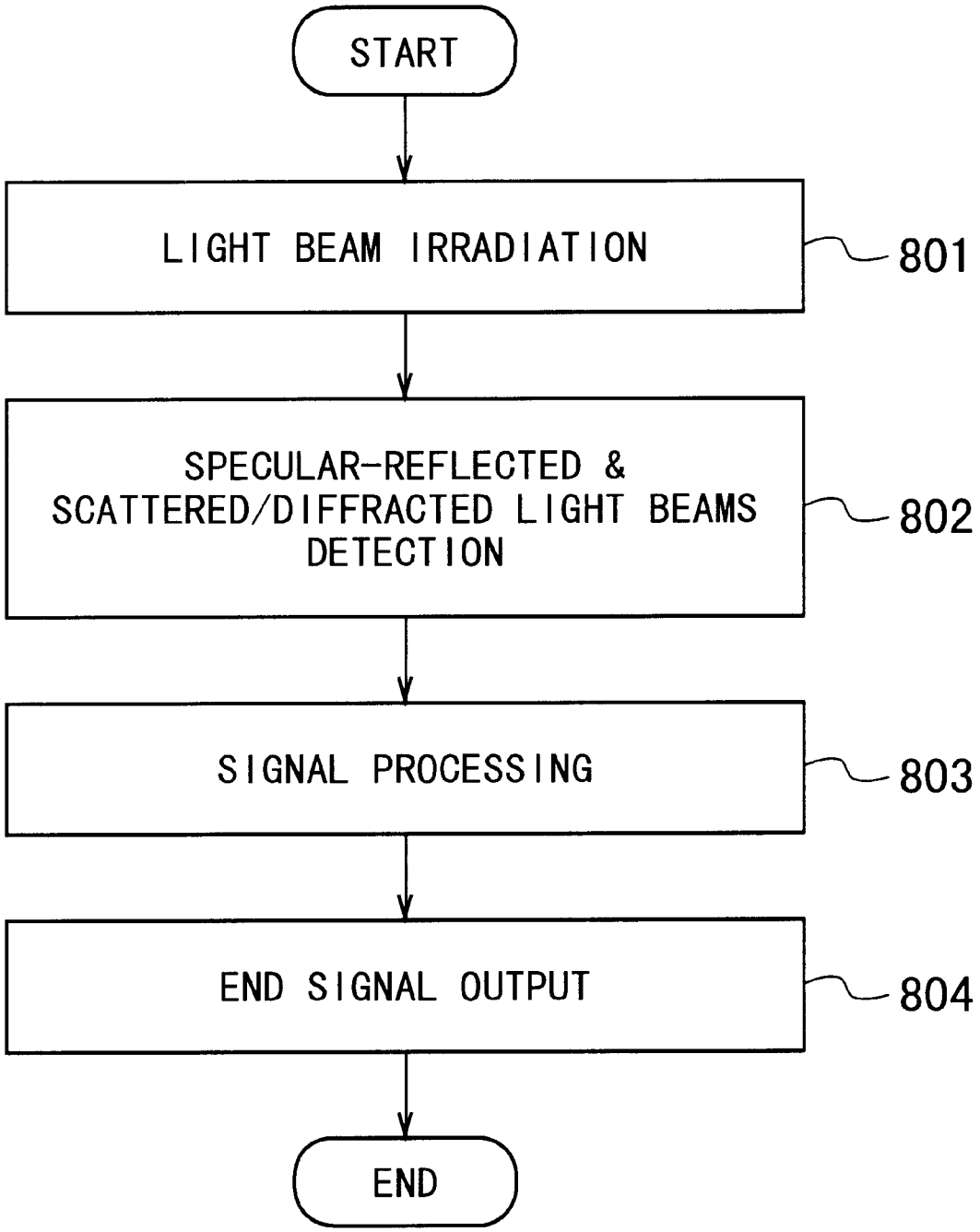
FIG. 11 is a flowchart showing the polishing process monitoring method carried out in the monitoring apparatus according to the first embodiment of FIG. 2.

FIG. 11 shows the flowchart of the polishing process monitoring method carried out in the monitoring apparatus 51 according to the first embodiment of FIG. 2.

First, in the step 801 in FIG. 11, the detection-light irradiator 41 irradiates the detection light beam 5 toward a specific location on the polishing surface of the wafer 1 (i.e., the surface of the metal layer 69) so that the beam 5 forms a specific angle with respect to the normal of the polishing surface. The specific angle is set to be smaller than the total reflection angle of the polishing surface. At the same time, the air beam 14 is emitted from the nozzle 17 to the polishing surface of the wafer 1, thereby forming the window 16*a* of the polishing slurry 16 to expose the polishing surface of the wafer 1 from the slurry 16. Thus, the detection area of the wafer 1 is formed on the surface of the wafer 1. The light beam 5 is irradiated to the polishing surface (i.e., detection area) through the window 16*a* and therefore, the beam 5 is reflected by the same surface. The beam 5 forms a spot of the specific diameter on the same surface.

While the metal layer 69 covers entirely the underlying dielectric layer 68, the light beam 5 is reflected by the flat surface of the metal layer 69 and therefore, almost all the incident beam 5 is reflected specularly. In other words, it can be thought that only the specularly-reflected beam 7 is formed. The specularly-reflected beam 7 is further reflected by the mirror 8 located on the optical axis of the beam 7 to be sent to the first photodiode 9. The photodiode 9 measures the amount of the beam 7 thus received and outputs the first electric signal a to the monitoring means 13 (the step 802 in FIG. 11).

When the underlying dielectric layer 68 is exposed to form the wiring lines 65 due to progress of the polishing process, the light beam 5 irradiated to the wafer 1 begins to be scattered and diffracted by the metallic wiring lines 65, forming the scattered/diffracted light beam 10.

If the light beam 5 transmits or penetrates through the exposed dielectric layer 68, the beam 5 is reflected by another wiring line located in the underlying layered structure 61. As a result, in this case, the light beam 5 is scattered and/or diffracted by both the metallic wiring lines 65 and the underlying wiring lines, forming the scattered/diffracted light beam 10.

If the metal layer 69 is extremely thin to allow the irradiated light beam 5 to transmit through the layer 69 to some extent, the scattered/diffracted light beam 10 is significantly generated from the start of the polishing process.

The scattered/diffracted light beam 10 thus formed is then condensed by the condensing lens 11 located on the optical axis of the specularly-reflected beam 7, and sent to the second photodiode 12 located at the condensing point of the lens 11. The photodiode 12 measures the amount of the beam 10 thus received and outputs the second electric signal b to the monitoring means 13 (the step 802 in FIG. 11).

The diameter and contour of the mirror 8 for reflecting the specularly-reflected beam 7 are determined in such a way that possible fluctuation in shape of the beam 7 due to the remaining slurry 16 in the window 16*a* on the polishing surface of the wafer can be covered and that the screening action of the mirror 8 to the scattered/diffracted light beam 10 is as weak as possible. The remaining slurry 16 in the window 16*a* may be needed from the viewpoint of the fabrication processing of the chips. Thus, almost all the scattered/diffracted light beam 10 around the optical axis of the beam 7 is received by the lens 11. As a result, the first signal a outputted from the first photodiode 9 is substantially proportional to the amount of only the specularly-reflected beam 7 and at the same time, the second signal b outputted from the second photodiode 12 is substantially proportional to the amount of only the scattered/diffracted light beam 10.

The monitoring means 13 receives the first and second signals a and b and performs a specific signal-processing operation using these signals a and b, outputting an end signal $S_{out}$ (the step 803 in FIG. 11). The end signal $S_{out}$ thus outputted makes it possible to monitor the polishing process of the wafer 1 in the polishing machine 50 based on the result of the signal-processing operation and to detect an optimum endpoint of the polishing process (the step 804 in FIG. 11).

The time-dependent change of the polished state of the wafer 1 (i.e., the signals a and b) varies according to various factors. For example, if at least one of the material and thickness of the metal layer 69, the dielectric layer 68, and the layered structure 61 of the wafer 1 is changed, the time-dependent change will be different from its initial one. Also, if the pattern geometry of the metal layer 69, the dielectric layer 68, and/or the layered structure 61 of the wafer 1 is/are different, the time-dependent change will not be the same. Moreover, the time-dependent change will vary according to whether a lot of patterns are arranged closely or coarsely on the wafer 1. The monitoring apparatus 51 according to the first embodiment of FIG. 2 is able to cope with any of these cases.

For example, if the reflectance of the metal layer 69 is quite different from that of the underlying structure 61, the amount of the specularly-reflected beam 7 varies within a wide range due to the reflectance change. Thus, the polished state of the wafer 1, i.e., the metal layer 69, can be monitored correctly using only the signal a.

If the reflectance of the metal layer 69 is slightly different from that of the underlying structure 61, the amount of the specularly-reflected beam 7 varies within a narrow range. Thus, the polished state of the wafer 1 is unable to be monitored using the amount of the specularly-reflected beam 7 (i.e., the signal a). However, instead of this, the amount of the scattered/diffracted light beam 10 (i.e., the signal b) varies within a wide range as the formation of the wiring lines 65 (or, the polishing of the metal layer 69) progresses.

Typically, the detection light beam 5 has a single wavelength. However, the beam 5 may have a plurality of wavelengths and a plurality of beams 5 may be used, as explained later. In this case, the spectral or wavelength characteristic of the reflectance of the wafer 1 may be used.

SECOND EMBODIMENT

Figure 4:
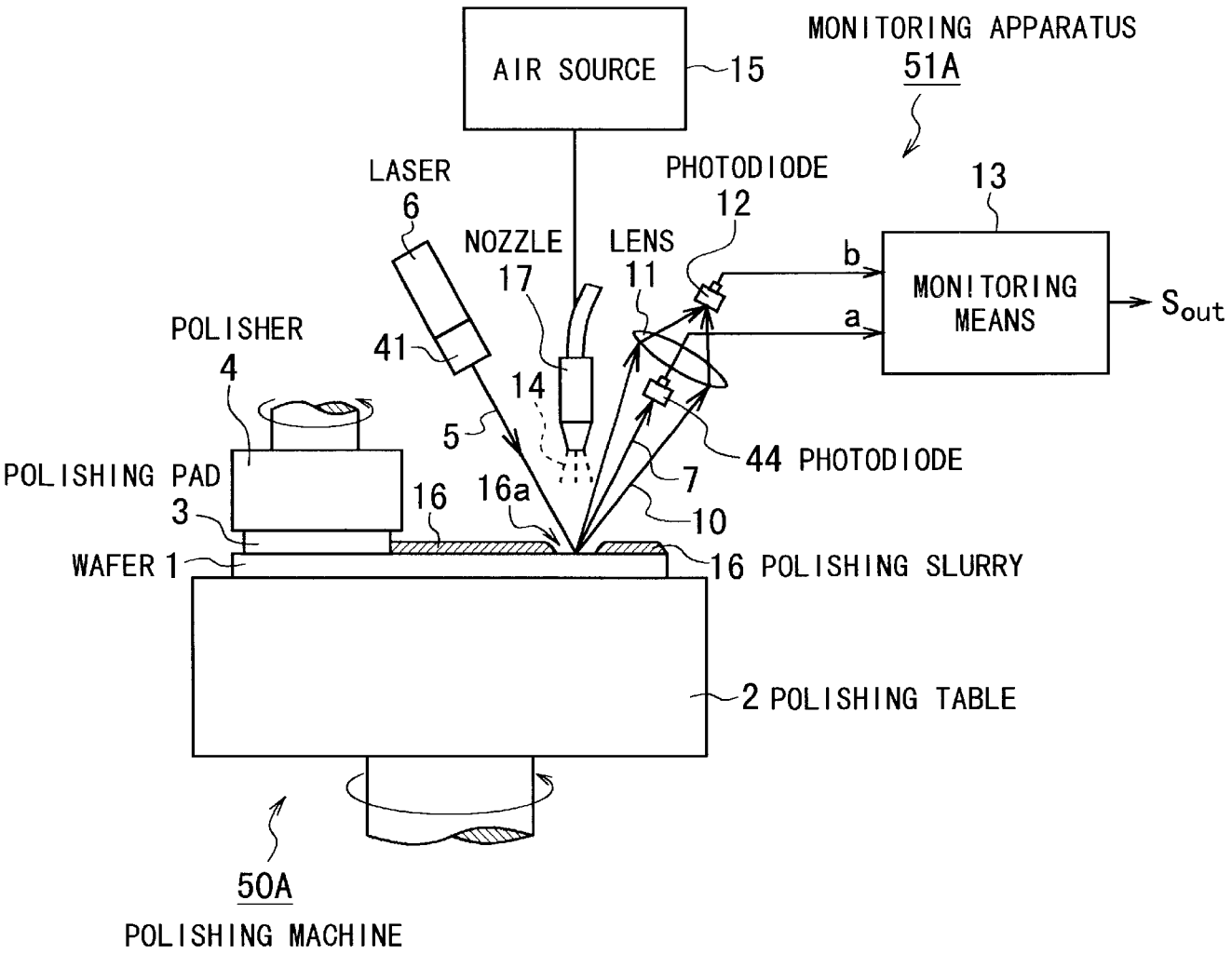
FIG. 4 is a schematic illustration showing the configuration of a polishing machine equipped with a polishing process monitoring apparatus according to a second embodiment of the present invention, in which a single detection light beam and specular-reflected and scattered/diffracted light beams are used.

FIG. 4 shows a polishing machine 50A equipped with a monitoring apparatus 51A according to a second embodiment of the present invention, which is comprised of the same polishing mechanism as that of the polishing machine 50 of FIG. 2. However, it has the monitoring apparatus 51A instead of the monitoring apparatus 51 according to the first embodiment of FIG. 2.

The monitoring apparatus 51A has the same configuration and operation as those of the monitoring apparatus 51 except that the specular-reflected light beam 7 generated from the detection light beam 5 is directly received by a photodiode 44. The photodiode 44 is located on the optical axis of the beam 7 at the near-side of the condensing lens 11. The photodiode 44 receives directly the specular-reflected light beam 7 and measures its amount, outputting a first electric signal a according to the measured amount of the specular-reflected light beam 7 to the monitoring means 13.

The diameter and contour of the light-receiving surface of the photodiode 44 are determined in such a way that possible fluctuation in shape of the beam 7 due to the remaining slurry 16 in the window 16*a* on the polishing surface of the wafer 1 can be covered and the screening action of the photodiode 44 to the scattered/diffracted light beam 10 is as weak as possible, respectively.

THIRD EMBODIMENT

Figure 5:
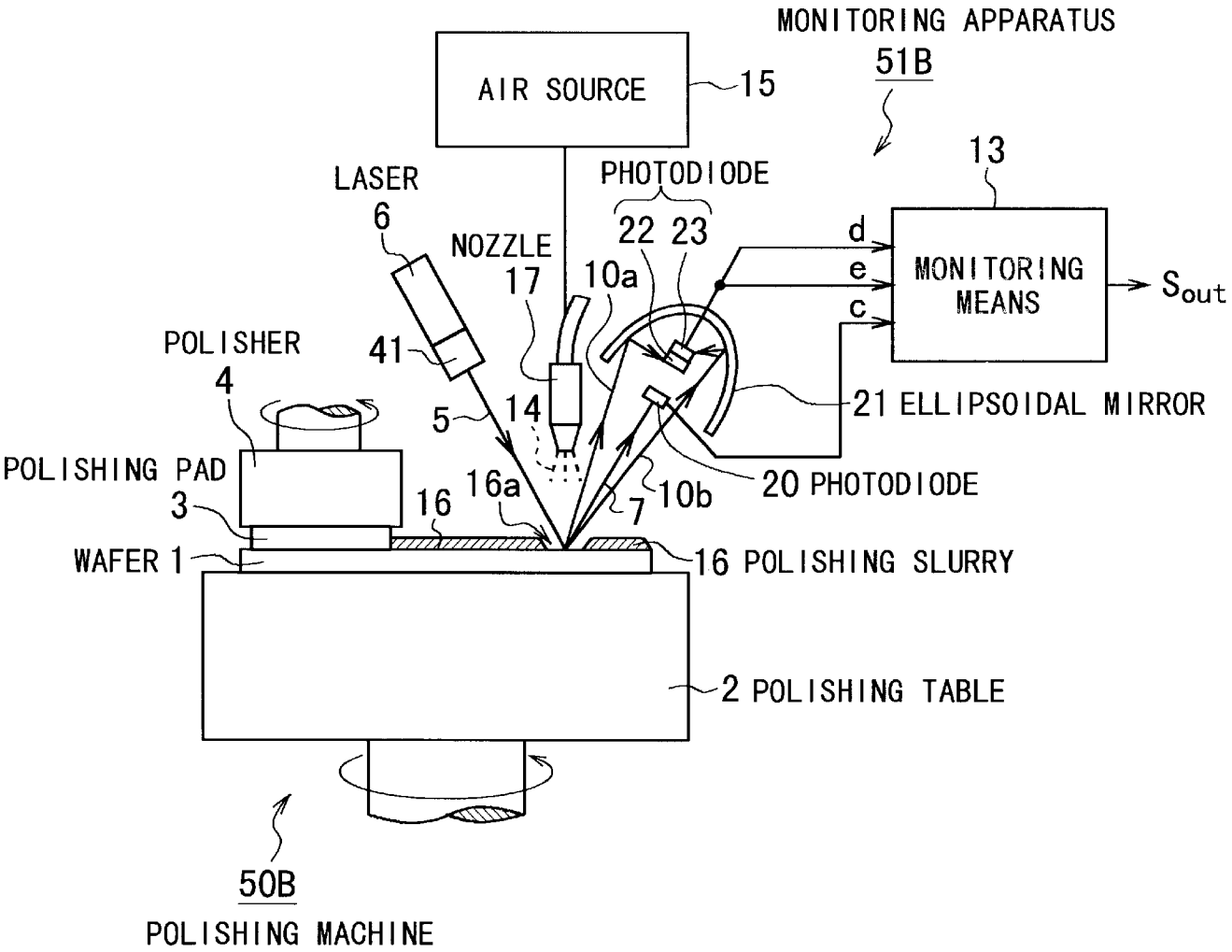
FIG. 5 is a schematic illustration showing the configuration of a polishing machine equipped with a polishing process monitoring apparatus according to a third embodiment of the present invention, in which a single detection light beam and specular-reflected and scattered/diffracted light beams are used.

FIG. 5 shows a polishing machine 50B equipped with a monitoring apparatus 51B according to a third embodiment of the present invention, which is comprised of the same polishing mechanism as that of the polishing machine 50 according to the first embodiment of FIG. 2. However, it has a monitoring apparatus 51B instead of the monitoring apparatus 51 according to the first embodiment of FIG. 2.

The monitoring apparatus 51B which monitors in situ the polishing process or polished state of the wafer 1, is comprised of a first photodiode 20, an ellipsoidal mirror 21, a second photodiode 22, and a third photodiode 23.

The first photodiode 20, which is located on the optical axis of the specular-reflected light beam 7, receives directly the specular-reflected light beam 7 and measures its amount, outputting a first electric signal c to the monitoring means 13.

The ellipsoidal mirror 21 is located on the optical axis of the specular-reflected light beam 7 at a position downstream with respect to the first photodiode 20. The second focal point of the mirror 21 is located at the same position as the irradiated position of the detection light beam 5 on the wafer (i.e., the detection area).

The second photodiode 22 is located on the first focal point of the mirror 21. The photodiode 22 receives the scattered/diffracted light beam 10 reflected by the forward surface of the mirror 21 with respect to the first focal point and measures its amount, outputting a second electric signal d to the monitoring means 13.

The third photodiode 23 is located at a position downstream with respect to the first focal point of the mirror 21. The photodiode 23 receives the scattered/diffracted light beam 10 reflected by the backward surface of the mirror 21 with respect to the first focal point and measures its amount, outputting a third electric signal e to the monitoring means 13.

The diameter of the light-receiving surface of the first photodiode 20 is set so as to cover the fluctuation of the spot shape of the specular-reflected beam 7 caused by the remaining polishing slurry 16 in the window 16*a*. The contour of the light-receiving surface of the first photodiode 20 is set so that the difference from the diameter of its light-receiving face and the screening action to the scattered/diffracted light beam 10 are minimum.

With the monitoring apparatus 51B according to the third embodiment of FIG. 5, as described above, the ellipsoidal mirror 21 is used instead of the condensing lens 11 in the second embodiment of FIG. 4, the other configuration and operation being the same as those of the first and second embodiments.

FOURTH EMBODIMENT

Figure 6:
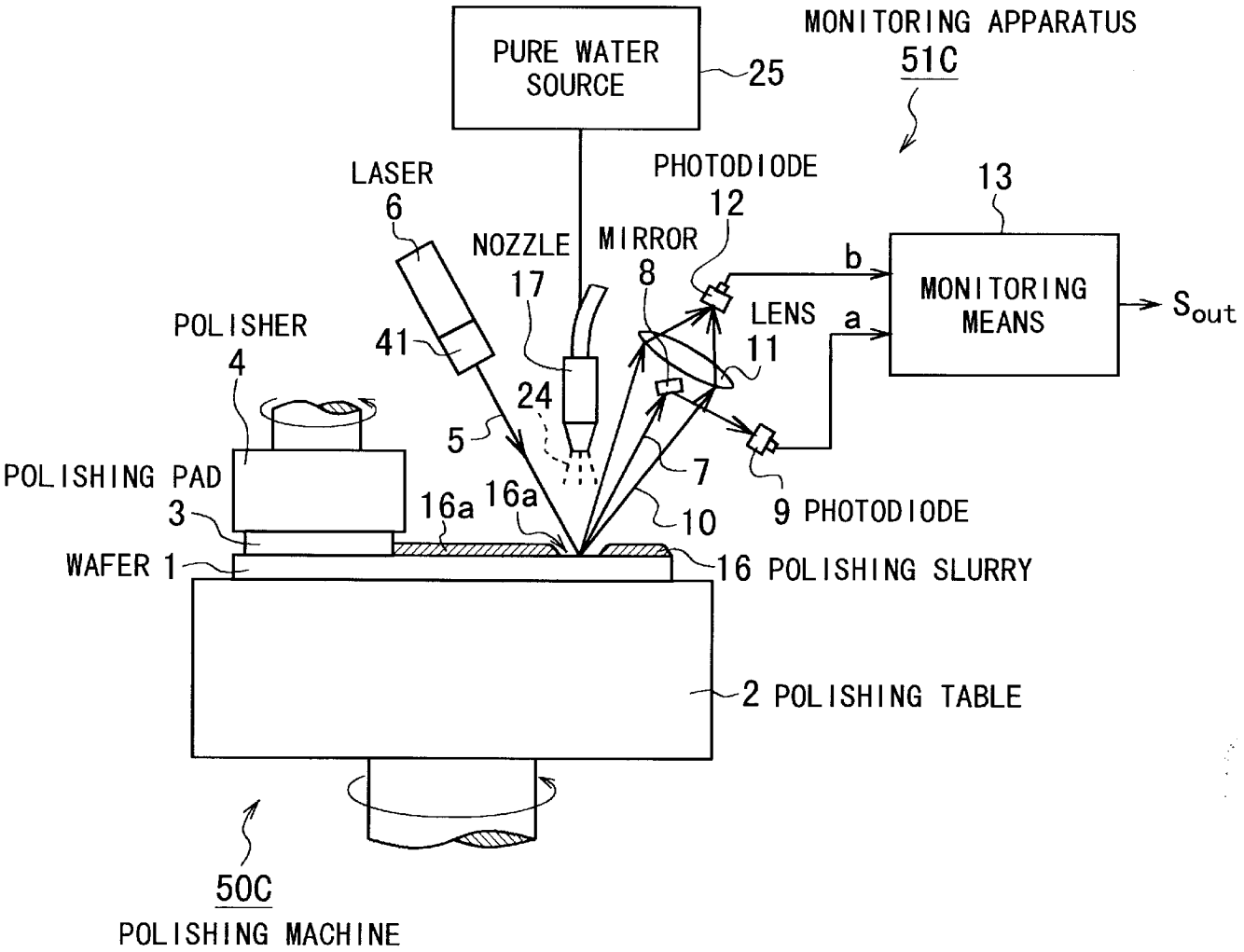
FIG. 6 is a schematic illustration showing the configuration of a polishing machine equipped with a polishing process monitoring apparatus according to a fourth embodiment of the present invention, in which a single detection light beam and specular-reflected and scattered/diffracted light beams are used.

FIG. 6 shows a polishing machine 50C equipped with a monitoring apparatus 51C according to a fourth embodiment of the present invention, which is comprised of the same polishing mechanism as that of the polishing machine 50 according to the first embodiment of FIG. 2. However, it has a monitoring apparatus 51C instead of the monitoring apparatus 51 according to the first embodiment of FIG. 2.

The monitoring apparatus 51C is comprised of a pure water source 25 instead of the air source 15, the other configuration and operation being the same as those of the first embodiment.

In the monitoring apparatus 51C, a pure water beam 24 is emitted from the nozzle 17 to be irradiated to the wafer 1 for forming the window 16*a* of the slurry 16 or the detection area of the wafer 1.

FIFTH EMBODIMENT

Figure 7:
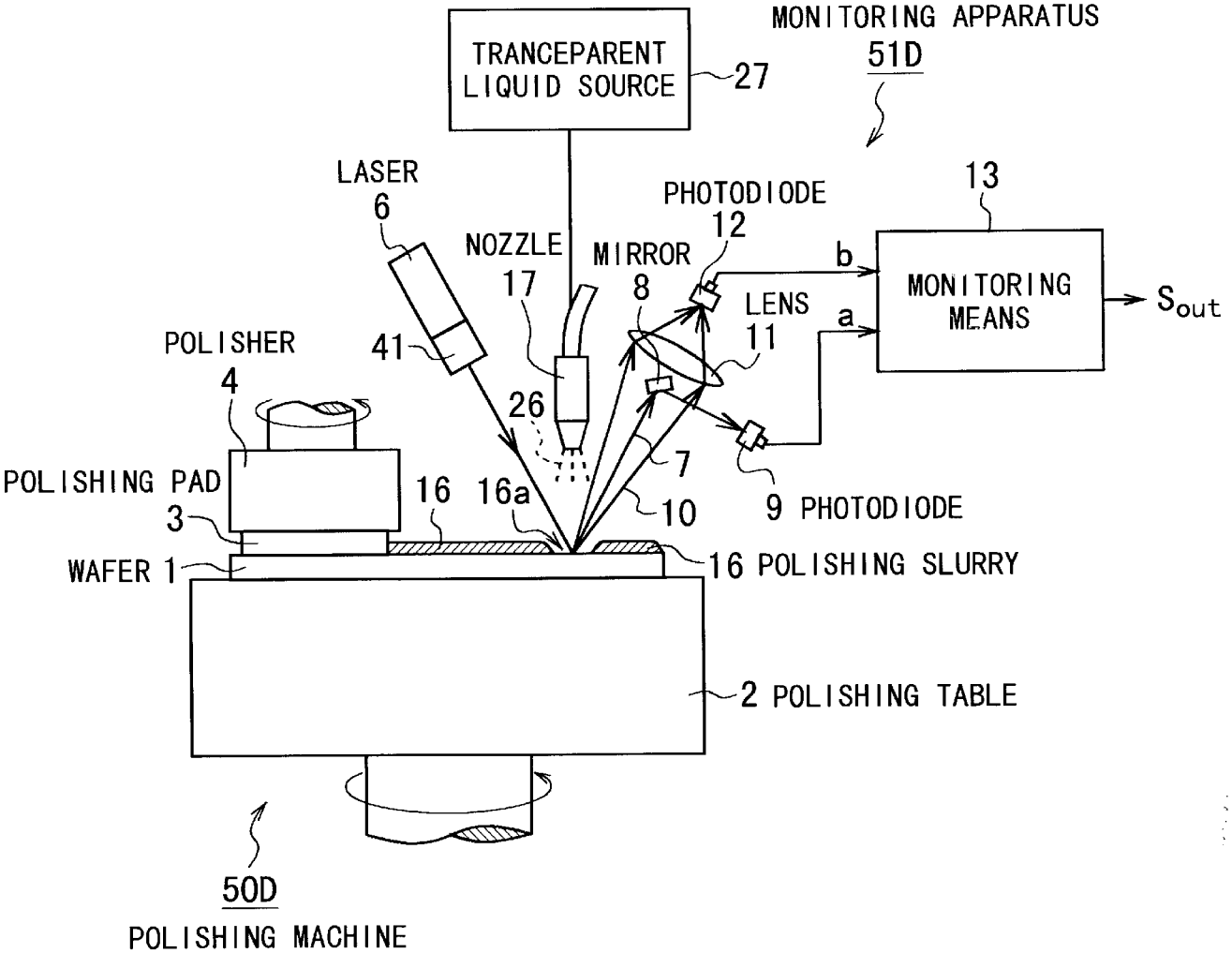
FIG. 7 is a schematic illustration showing the configuration of a polishing machine equipped with a polishing process monitoring apparatus according to a fifth embodiment of the present invention, in which a single detection light beam and specular-reflected and scattered/diffracted light beams are used.

FIG. 7 shows a polishing machine 50D equipped with a monitoring apparatus 51D according to a fifth embodiment of the present invention, which is comprised of the same polishing mechanism as that of the polishing machine 50 according to the first embodiment of FIG. 2. However, it has a monitoring apparatus 51D instead of the monitoring apparatus 51 according to the first embodiment of FIG. 2.

The monitoring apparatus 51D is comprised of a transparent liquid source 27 instead of the air source 15, the other configuration and operation being the same as those of the first embodiment. Any liquid which is transparent with respect to the detection light beam 5 may be used for this purpose.

In the monitoring apparatus 51D, a transparent liquid beam 26 is emitted from the nozzle 17 to be irradiated to the wafer 1 for forming the window 16*a* of the slurry 16.

SIXTH EMBODIMENT

Figure 8:
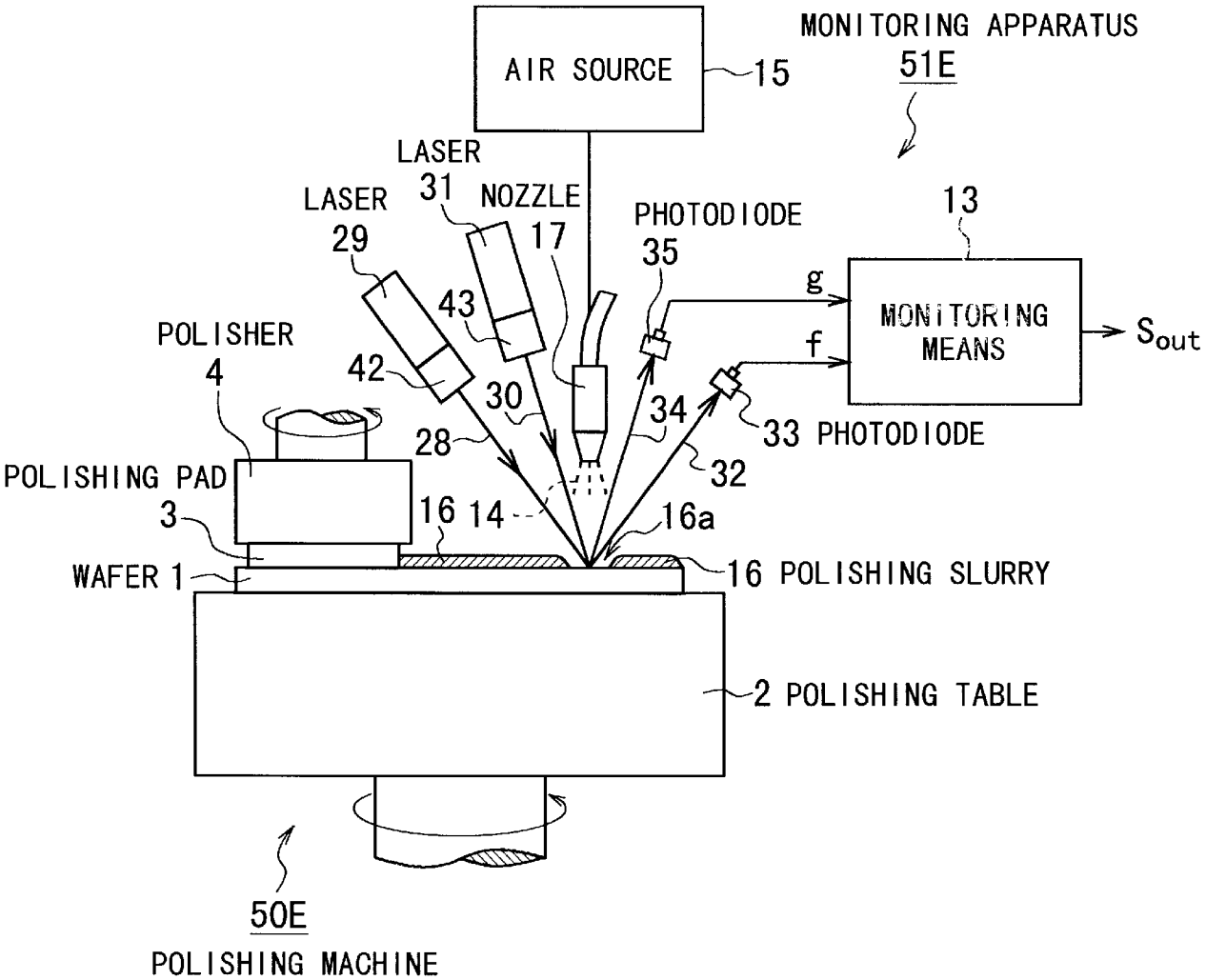
FIG. 8 is a schematic illustration showing the configuration of a polishing machine equipped with a polishing process monitoring apparatus according to a sixth embodiment of the present invention, in which two detection light beams having different wavelengths and specular-reflected and scattered/diffracted light beams are used.

FIG. 8 shows a polishing machine 50E equipped with a monitoring apparatus 51E according to a sixth embodiment of the present invention, which is comprised of the same polishing mechanism as that of the polishing machine 50 according to the first embodiment of FIG. 2. However, it has a monitoring apparatus 51E instead of the monitoring apparatus 51 according to the first embodiment of FIG. 2.

The monitoring apparatus 51E is comprised of a first laser 29, a first detection-light irradiator or controller 42, a second laser 31, a second detection-light irradiator or controller 43, a first photodiode 33, and a second photodiode 34.

The first laser 29 serves as a light source for a first detection light beam 28. The first detection-light irradiator 42 irradiates the light generated by the first laser 29 as the first detection light beam 28 toward a specific location on the polishing surface of the wafer 1 so that the beam 28 forms a specific angle with respect to the polishing surface of the wafer 1 and a spot of a specific diameter on the same polishing surface.

The second laser 31 serves as a light source for a second detection first light beam 30. The second detection-light irradiator 43 irradiates the light generated by the second laser 31 as the second detection light beam 30 toward the same location on the polishing surface of the wafer 1 so that the beam 30 forms a specific angle with respect to the polishing surface of the wafer 1 and a spot of a specific diameter on the same polishing surface. The second detection first light beam 30 has a different wavelength from that of the first detection light beam 28. The angle of the second detection light beam 30 with respect to the polishing surface of the wafer 1 is different from that of the first detection light beam 28.

The first photodiode 33 serves as a light receiver and is located on the optical axis of a first specular-reflected light beam 32 generated by the first detection light beam 28. The photodiode 33 receives the first specular-reflected light beam 32 and measures its amount, outputting a first electric signal f according to the measured amount of the first specular-reflected light beam 32 to the monitoring means 13.

The second photodiode 35 serves as a light receiver and is located on the optical axis of a second specular-reflected light beam 34 generated by the second detection light beam 30. The photodiode 35 receives the second specular-reflected light beam 34 having the different wavelength from that of the first specular-reflected light beam 32 and measures its amount, outputting a second electric signal g according to the measured amount of the second specular-reflected light beam 34 to the monitoring means 13.

The other configuration and operation are the same as those of the first embodiment of FIG. 2.

In the monitoring apparatus 51E, as described above, the monitoring means 13 realizes the monitoring operation of the polishing process of the wafer 1 based on the change of the measured amounts of the first and second specular-reflected light beams 32 and 34 having the different wavelengths. This is unlike the first embodiment of FIG. 2 where the measured amounts of the specular-reflected light beam 7 and the scattered/diffracted light beam 10 having the same wavelength are used for this purpose.

Next, the operation of the monitoring apparatus 51E according to the sixth embodiment is explained below.

Figure 21:
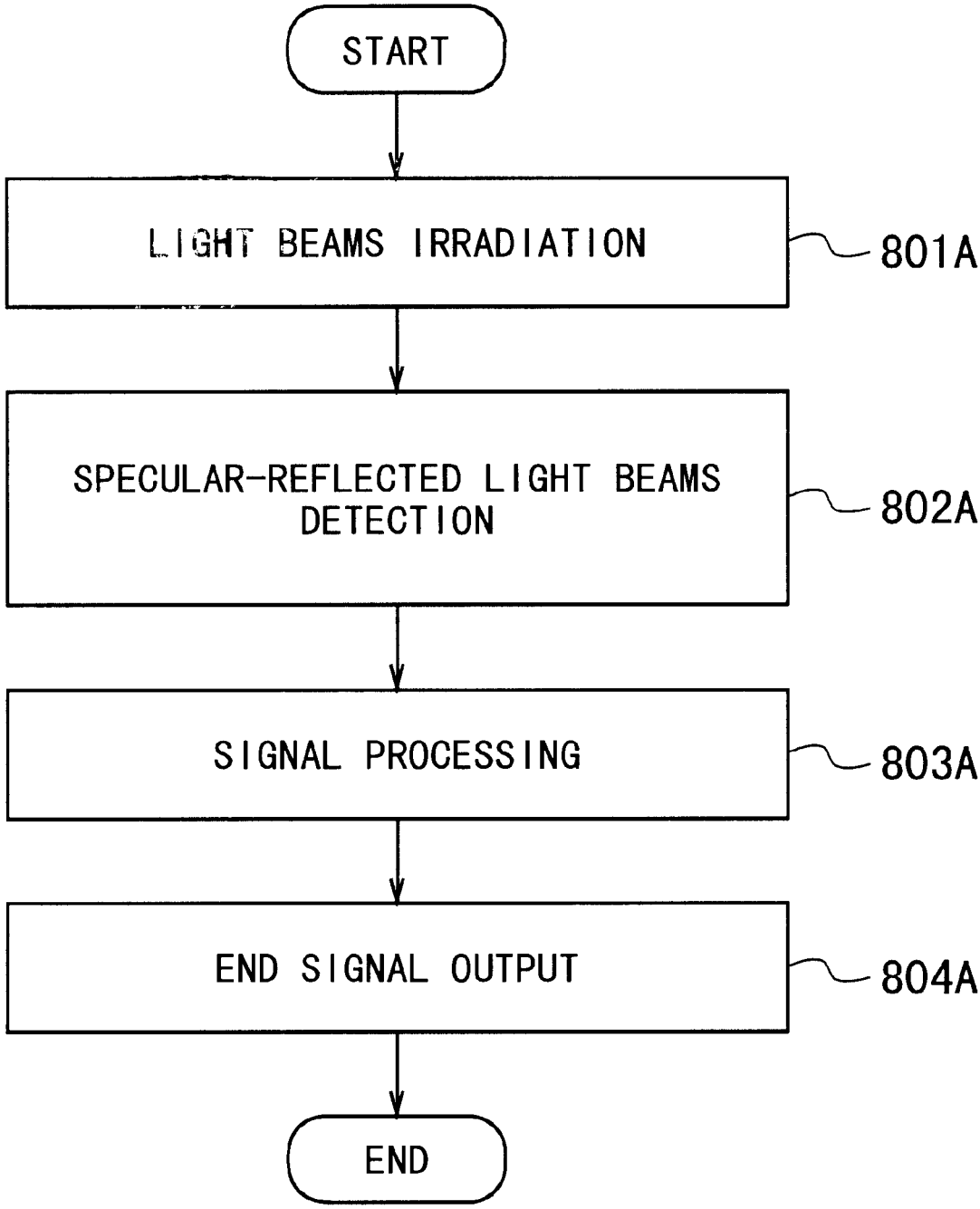
FIG. 21 is a flowchart showing the polishing process monitoring method carried out in the monitoring apparatus according to the sixth embodiment of FIG. 8.

FIG. 21 shows the flowchart of the polishing process monitoring method carried out in the monitoring apparatus 51E according to the sixth embodiment of FIG. 8.

First, in the step 801A, the first and second detection-light irradiators 42 and 43 irradiate the first and second detection light beams 28 and 30 having the different wavelengths from each other toward the same specific location on the polishing surface of the wafer 1 (i.e., the surface of the metal layer 69). This specific angles for the beams 28 and 30 are set to be smaller than the total reflection angle of the polishing surface.

The wavelength of the first detection light beam 28 is set so that the reflectance at the metal layer 69 is greater than those of the underlying dielectric layer 68 and the structure 61. On the other hand, the wavelength of the second detection light beam 30 is set so that the reflectance at the metal layer 69 is less than those of the underlying dielectric layer 68 and the structure 61.

The air beam 14 is emitted from the nozzle 17 to the polishing surface of the wafer 1, thereby forming the window 16*a* of the polishing slurry 16 to expose the polishing surface of the wafer 1 from the slurry 16. The first and second light beams 28 and 30 are irradiated to the polishing surface through the window 16*a* and therefore, the beams 28 and 30 are reflected by the same detection area of the wafer 1. Each of the beams 28 and 30 forms a spot of the specific diameter on the same detection area.

While the metal layer 69 covers entirely the underlying dielectric layer 68, the light beams 28 and 30 are reflected by the flat surface of the metal layer 69 and therefore, almost all the incident beams 28 and 30 are reflected specularly. In other words, it can be thought that only the first and second specularly-reflected beams 32 and 34 are formed. The first specularly-reflected beam 32 is received by the photodiode 33 located on the optical axis of the beam 32. The photodiode 33 measures the amount of the beam 32 thus received and outputs the first electric signal f to the monitoring means 13. Similarly, the second specularly-reflected beam 34 is received by the photodiode 35 located on the optical axis of the beam 34. The photodiode 35 measures the amount of the beam 34 thus received and outputs the second electric signal g to the monitoring means 13 (the steps 802 in FIG. 21).

The first and second electric signals f and g vary according to the progress of the polishing process in the following way.

Since the wavelength of the first detection light beam 28 is set so that the reflectance at the metal layer 69 is greater than those at the underlying dielectric layer 68 and the structure 61, the first electric signal f for the first detection light beam 28 decreases in level as the underlying dielectric layer 68 is exposed from the metal layer 69. In contrast, since the wavelength of the second detection light beam 30 is set so that the reflectance at the metal layer 69 is less than those at the underlying dielectric layer 68 and the structure 61, the second electric signal g for the second detection light beam 30 increases in level as the underlying dielectric layer 68 is exposed from the metal layer 69. Also, after the metal layer 69 is polished until the dielectric layer 69 is exposed, substantially no change occurs in the surface-area ratio between the remaining metal layer 69 and the exposed dielectric layer 68. As a result, the first and second signals f and g will not change.

Consequently, using the distinctive change in the spectral reflectance characteristics through the first and second signals f and g, the monitoring means 13 carries out the monitoring and endpoint detection operations for the polishing process (the steps 803A and 804A in FIG. 21).

Although two detection light beams having different wavelengths are used in this embodiment, it is obvious that three or more detection light beams having different wavelengths may be used.

Also, two detection light beams having different wavelengths are irradiated along different optical axes in this embodiment. However, two or more detection light beams having different wavelengths may be irradiated along the same optical axis, i.e., coaxially. In this case, these detection light beams are separated by a spectrum analyzer such as a wavelength selection filter, a wavelength selection mirror, and a diffraction grating. As a light source, a multi-line laser is preferably used for this case. An example of this case is shown in FIG. 9.

Figure 9:
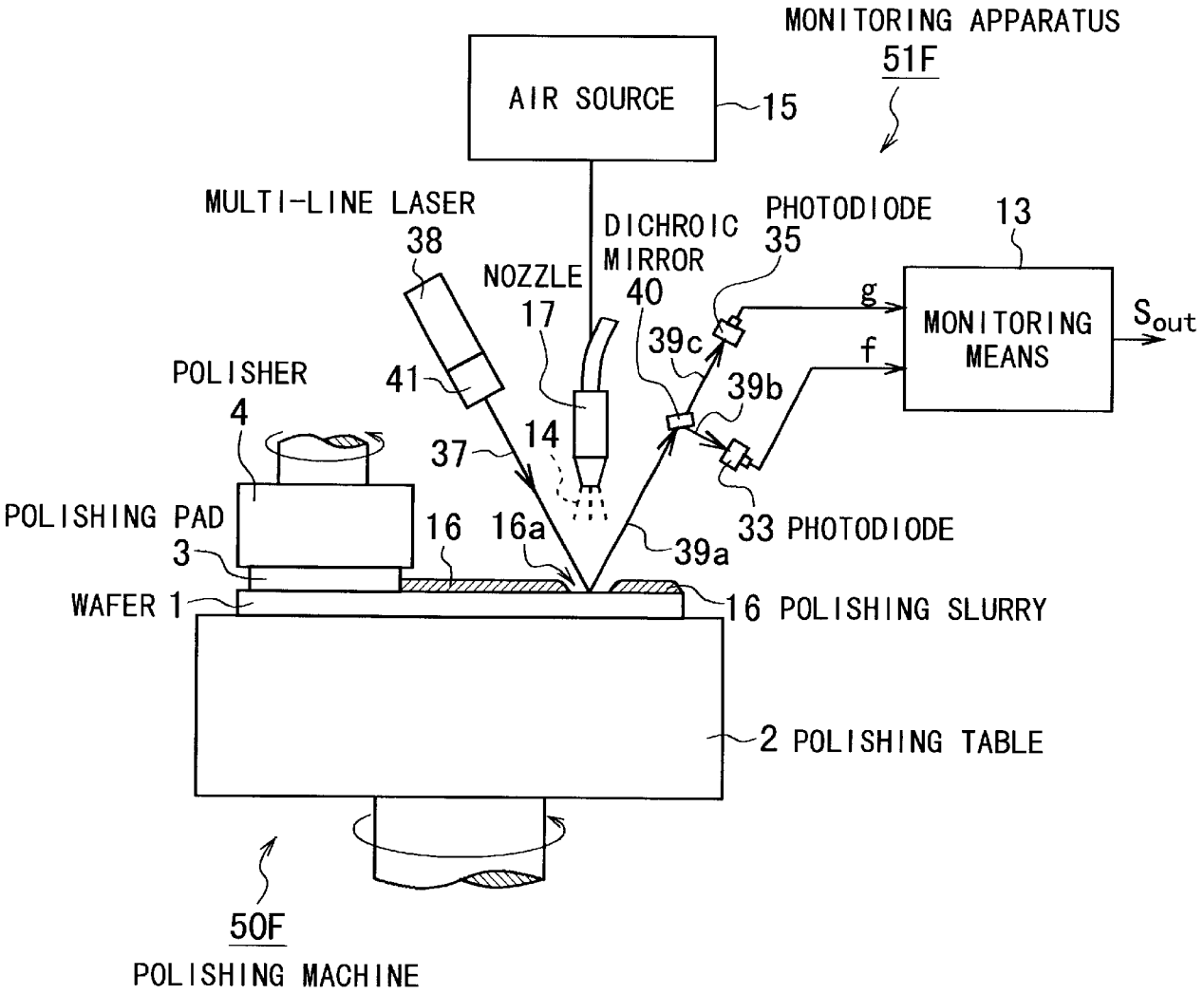
FIG. 9 is a schematic illustration showing a variation of the polishing machine according to the sixth embodiment of FIG. 8, in which a single detection light beam having different wavelengths and specular-reflected and scattered/diffracted light beams are used.

In FIG. 9, a polishing machine 50F is equipped with a monitoring apparatus 51F, which is comprised of the same polishing mechanism as that of the polishing machine 50 according to the first embodiment of FIG. 2. The monitoring apparatus 51F has the following configuration.

A multi-line laser 38 is used to generate a detection light beam 37 having two different wavelengths and the beam 37 is irradiated to the polishing surface of the wafer 1 along an optical axis. A specular-reflected light beam 39*a* having two different wavelengths, which is generated by reflection at the wafer 1, is received by a dichroic mirror 40, thereby forming two specular-reflected light beams 39*b* and 39*c* according to their wavelengths. The light beams 39*b* and 39*c* are received by the photodiodes 33 and 34, respectively, producing the first and second electric signals f and g.

Moreover, in addition to the specular-reflected light beams 28 and 30 in FIG. 8 (or the specular-reflected light beam 37 in FIG. 9), a scattered/diffracted light beam or beams may be detected for monitoring the polishing process, as explained in the above-described first to fifth embodiments.

SEVENTH EMBODIMENT

Figure 10:
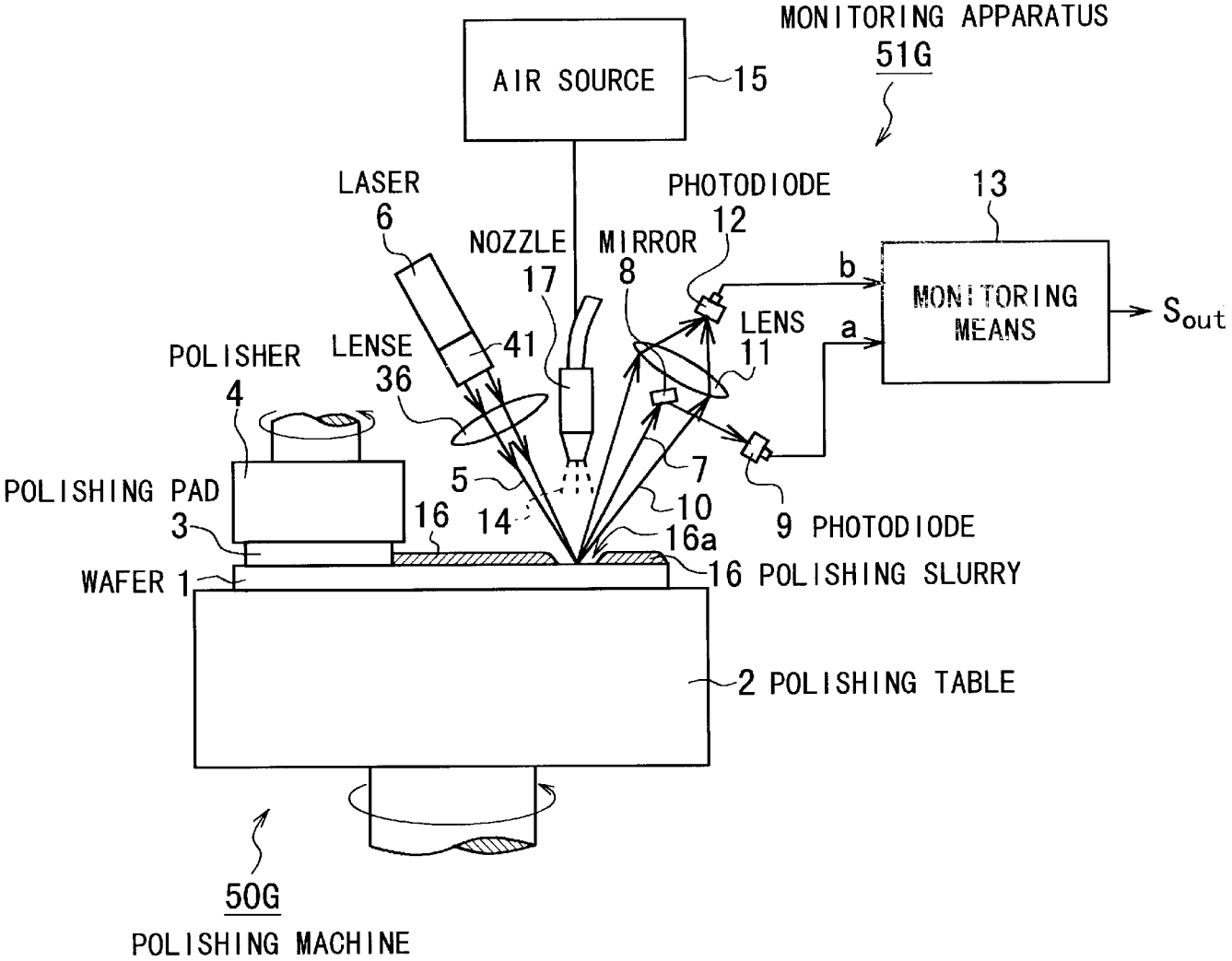
FIG. 10 is a schematic illustration showing the configuration of a polishing machine equipped with a polishing process monitoring apparatus according to a seventh embodiment of the present invention, in which a single detection light beam, a beam-condensing lens, and specular-reflected and scattered/diffracted light beams are used.

FIG. 10 shows a polishing machine 50G equipped with a monitoring apparatus 51G according to a seventh embodiment of the present invention, which is comprised of the same polishing mechanism as that of the polishing machine 50 according to the first embodiment of FIG. 2. However, it has a monitoring apparatus 51G instead of the monitoring apparatus 51 according to the first embodiment of FIG. 2.

The monitoring apparatus 51G has the same configuration as that of the first embodiment except that a condensing lens 36 is additionally provided. The lens 36, which is located on the optical axis of the beam 5, condenses the detection light beam 5 to have a diameter smaller than that of a specific pattern on the wafer 1.

As already explained above, the detection light beam 5 used in the first embodiment of FIG. 2 is a beam of parallel light rays. Unlike this, in the seventh embodiment of FIG. 10, the detection light beam 36 is condensed by the lens 36 and irradiated to the polishing surface (or, detection area) of the wafer 1, thereby decreasing the spot size of the beam 36 on the polishing surface than a comparative-large, specific pattern on the wafer 1, such as a power supply line, a bump, and a scribe.

Next, the operation of the monitoring apparatus 51G according to the seventh embodiment is explained below.

Figure 24:
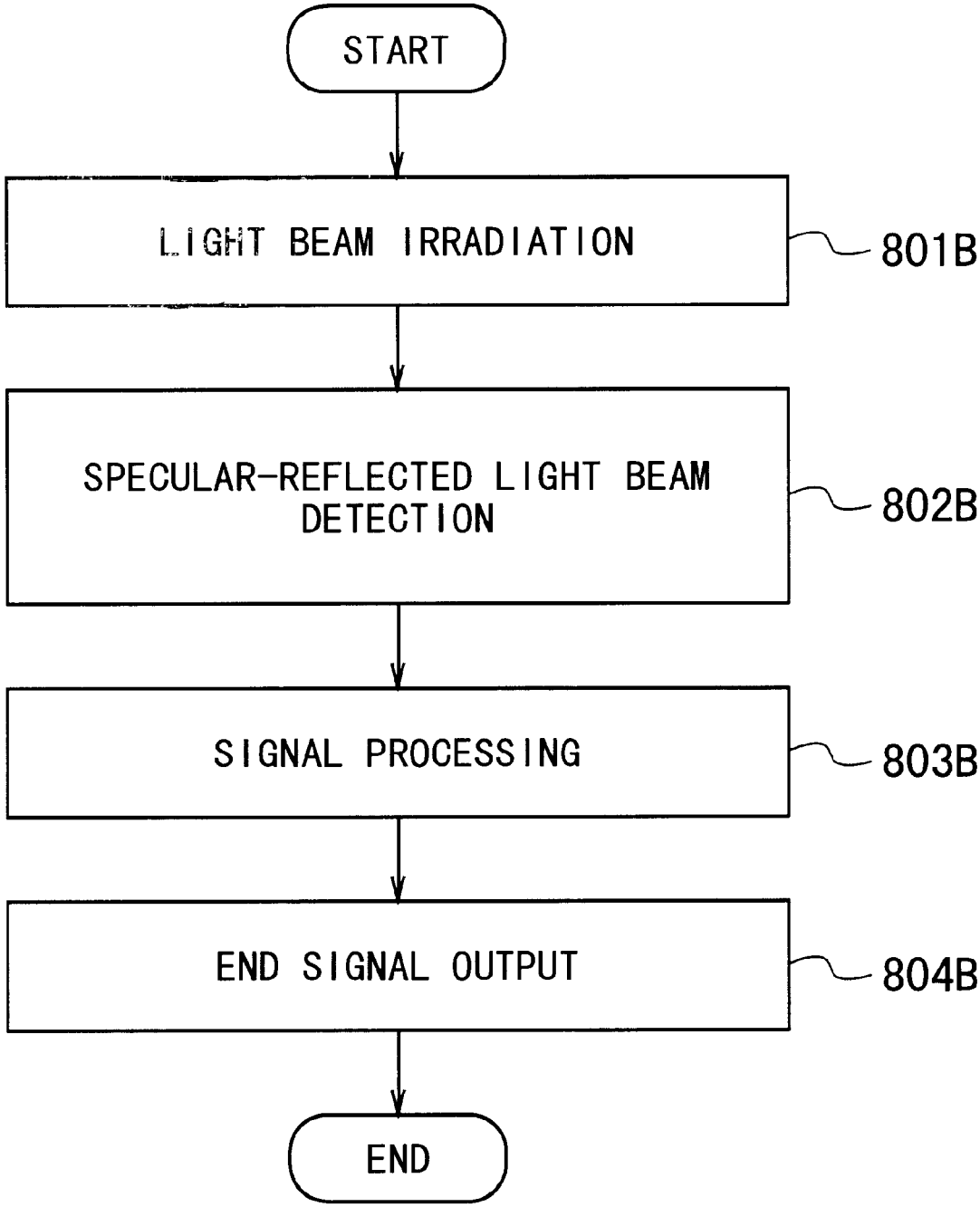
FIG. 24 is a flowchart showing the polishing process monitoring method carried out in the monitoring apparatus according to the seventh embodiment of FIG. 10.

FIG. 24 shows the polishing process monitoring method carried out in the monitoring apparatus according to the seventh embodiment of FIG. 10, in which the steps 801B to 804B are carried out. These steps 801B to 804B are substantially the same as those in FIG. 21.

After the underlying dielectric layer 68 begins to be exposed from the metal layer 69 due to the progressing polishing process, the level of the first and second electric signals a and b is substantially equal to that obtained when the dielectric layer 68 is entirely covered with the metal layer 69 under the condition that the condensed light beam 5 is reflected by the specific pattern on the wafer 1. However, if the condensed light beam 5, is reflected by any area other than the specific pattern, the level of the first and second electric signals a and b is changed due to the exposed dielectric layer 68. Accordingly, the maximum value of the signals a and b during a specific time period exhibits substantially no change while the minimum value of the signals a and b during the same specific time period exhibits significant change, resulting in significant change of the mean or average value of the signals a and b during the same specific time period.

Thus, the monitoring means 13 monitors the polishing process of the wafer 1 based on the change of the difference or ratio between the mean and maximum values of the signals a and b during each of the specific time periods, detecting correctly an endpoint of the polishing process.

As the means for receiving the specular-reflected and scattered/diffracted light beams 7 and 10, any one of the configurations used in the second to sixth embodiments may be used.

EIGHTH EMBODIMENT

Figure 12:
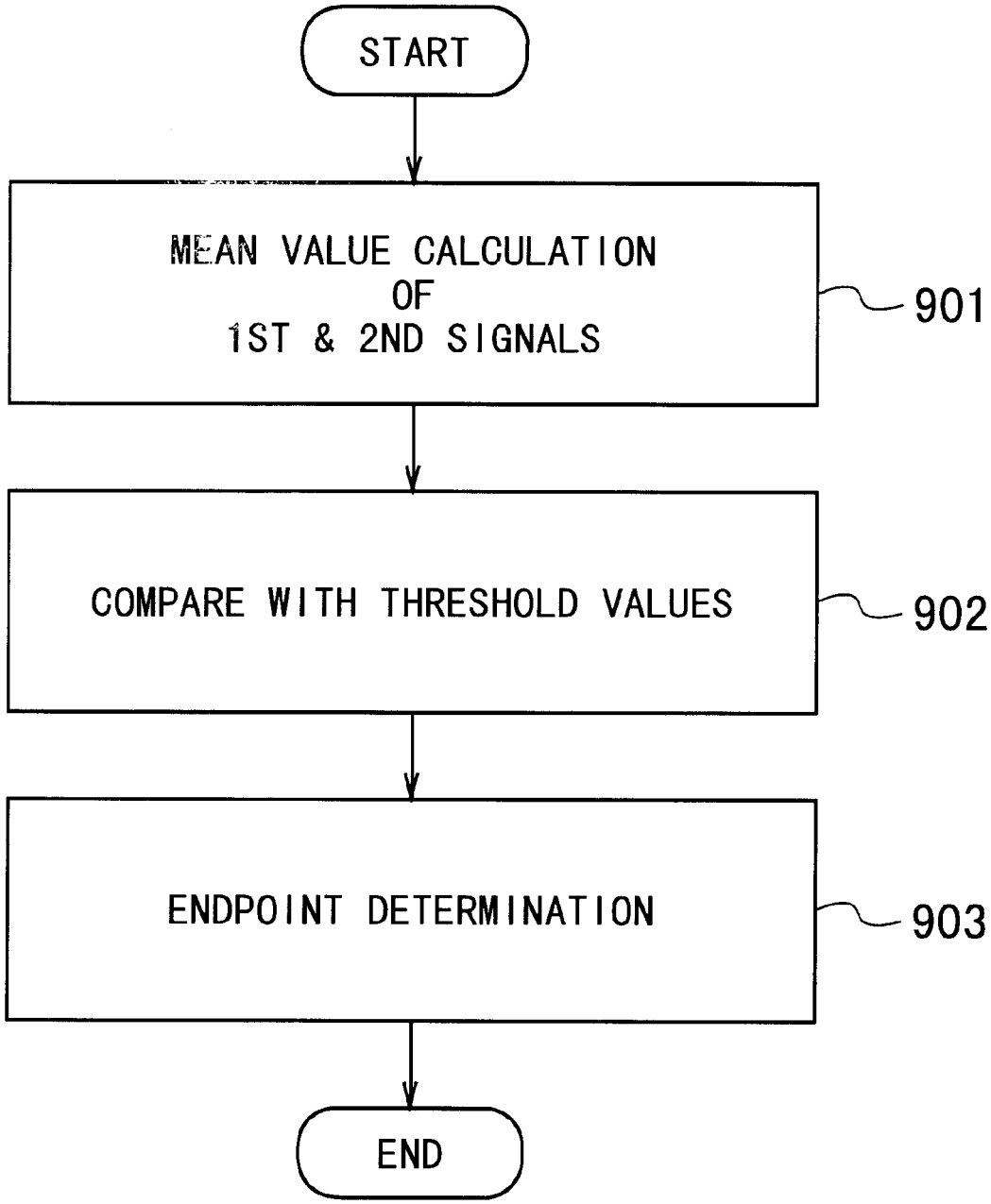
FIG. 12 is a flowchart showing an endpoint detection method of a polishing process according to an eighth embodiment of the present invention, in which the monitoring apparatus according to the first embodiment of FIG. 2 is used.

FIG. 12 shows a flowchart showing an endpoint detection method according to an eighth embodiment of the present invention, which is performed by the monitoring apparatus 51 of FIG. 2 according to the first embodiment. The endpoint detection method is carried out in the steps 803 and 804 in FIG. 11.

In the step 901, a mean or average value of the amount of each of the specular-reflected and scattered/diffracted light beams 7 and 10 (i.e., the first and second electric signals a and b) during a specific time period is calculated.

In the step 902, the calculated mean values for the beams 7 and 10 are compared with their specific threshold values, respectively.

In the step 903, the time when at least one of the mean values for the light beams 7 and 10 is higher or lower than their threshold values is determined as an endpoint of the polishing process.

The endpoint detection method according to the eighth embodiment is preferably used in the monitoring apparatuses according to the first to fifth and seventh embodiments.

Next, the above steps 901 to 903 are explained in more detail below with reference to FIG. 2.

In the step 901, the first and second electric signals a and b are averaged during the specific time period, resulting in the averaged or mean values. Since the wafer 1 is rotated in the overall polishing process, the density and orientation of the patterns contained in the spot of the detection light beam 5 always vary. Therefore, the level or intensity of the first and second electric signals a and b always vary. This means that the change of the signals a and b according to the change of the polished state is buried under the change of the signals a and b according to the change of the density and orientation of the rotating patterns.

To cope with this, by averaging the change of the signals a and b in the specific time period, the change of the signals a and b according to the change of the polished state can be made independent of the change according to the change of the density and orientation of the rotating patterns.

Since the detection light beam 5 passes through the same point on the polishing surface of the wafer 1 in each rotation, and the same change of the density and orientation of the rotating patterns is repeated in each rotation, the specific time period for averaging is preferably set as the time necessary for each rotation of the wafer 1. In other words, the change of the signals a and b are averaged in the time period for each rotation of the wafer 1.

The wafer 1 usually contains a lot of same IC chips and therefore, the specific time period for averaging may be set as the time necessary for the beam 5 to pass through each chip.

The averaged time-dependent change of the signals a and b vary according to the wavelength of the beam 5, the reflectance of the metal layer 69, the reflectance of the dielectric layer 68 and the structure 61, and the geometric shapes and closeness/coarseness of the patterns on the wafer 1.

Figure 13:
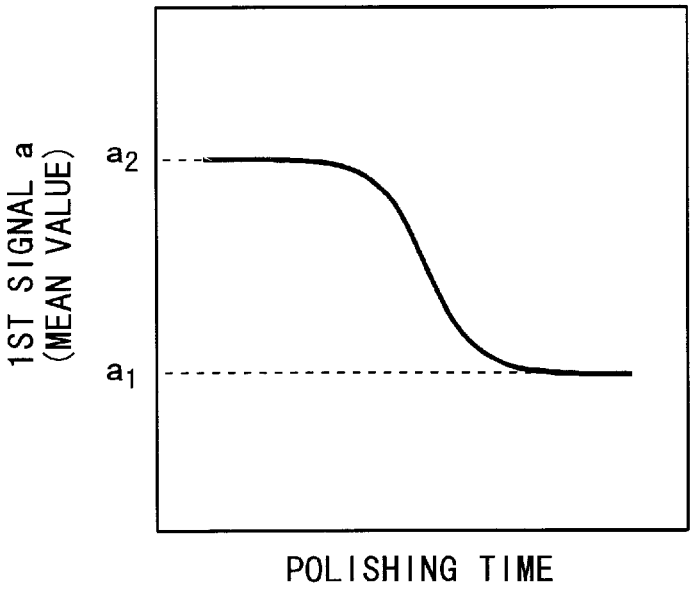
FIG. 13 is a graph showing schematically the time-dependent change of the first electric signal a corresponding to the amount of the specular-reflected light beam.
Figure 14:
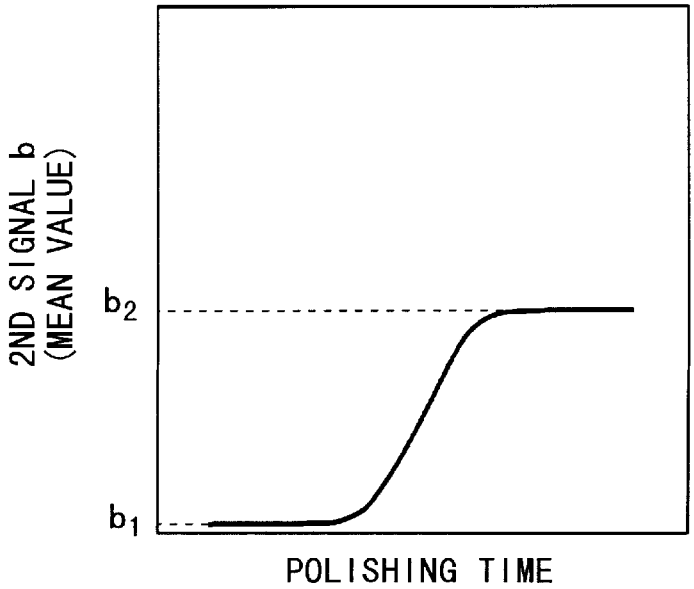
FIG. 14 is a graph showing schematically the time-dependent change of the second electric signal b corresponding to the amount of the scattered/diffracted light beam.

FIGS. 13 and 14 show schematically the time-dependent change of the first and second electric signals a and b, respectively. As seen from FIGS. 13 and 14, the wavelength of the detection light beam 5 is selected so that the reflectance of the metal layer 69 is higher than that of the underlying dielectric layer 68.

While the dielectric layer 68 is not exposed from the metal layer 69 after the start of the polishing process, the light beam 5 is reflected specularly by the mirror-like surface of the metal layer 69 having a high reflectance. Therefore, the first electric signal a has a large value, which is kept approximately constant, as shown in FIG. 13. At this stage, the scattered/diffracted light beam 10 is scarcely generated because the metal layer 69 has a flat and mirror-like surface and therefore, the second electric signal b has an extremely small value, which is approximately equal to zero, as shown in FIG. 14.

The surface of the metal layer 69 may not be like a mirror according to the deposition or formation method used therefor. In this case, the first signal a increase until the surface of the metal layer 69 is polished like a mirror and then, it is kept approximately constant until the dielectric layer 69 begins to be exposed from the metal layer 68.

Subsequently, after the dielectric layer 69 begins to be exposed from the metal layer 68, in other words, after the metal layer 69 becomes extremely thin to allow the light beam 5 to penetrate through the metal layer 69, the amount of the detection light beam 5 reflected specularly by the metal layer 69 and the underlying structure 61 is decreased and at the same time, the amount of the detection light beam 5 scattered or diffracted by the dielectric layer 68 and the underlying structure is increased. This means that the effect of the reflectance of the dielectric layer 68 and the underlying structure 61 appears. At this stage, the level of the first signal a is lowered after the total specular-reflected light beam 7 generated by the reflection of the metal layer 69 and the underlying structure 61 is decreased significantly.

If the dielectric layer 68 is transparent or semi-transparent with respect to the detection light beam 5, a part of the light beam 5 is reflected specularly by the metal layer 69 and the underlying structure 61 through the dielectric layer 68. The specular-reflected light beam 7 thus formed is received by the first photodiode 9. Another part of the light beam 5 is scattered or diffracted by the wiring lines 65 and the underlying structure 61, forming the scattered/diffracted light beam 10. The scattered/diffracted light beam 10 thus formed is received by the second photodiode 12. At this stage, the level of the second signal b is raised according to the exposure of the dielectric layer 68 and the formation of the wiring lines 65.

After the endpoint of the polishing process, i.e., the wiring lines 65 are completely formed, as shown in FIG. 3C, the surface-area ratio of the completed wiring lines 65 and the exposed dielectric layer 68 does not change even if the polishing process is further advanced. Thus, the first and second signals a and b are kept approximately constant.

As a result, the correct endpoint of the polishing process is determined as the time when the level of the first electric signal a is lower than its threshold value (not shown in FIG. 13). If the level of the first electric signal a has a relative maximum value, the correct endpoint is determined as the time when the level of the first electric signal a is lower than its threshold value after it exceeds the relative maximum value. Alternately, the correct endpoint is determined as the time when the level of the second electric signal b is higher than its threshold value (not shown in FIG. 14). Moreover, the correct endpoint may be determined as the time when both the first and second signals a and b satisfy the above conditions, respectively.

In FIG. 13, the symbols a1 and a2 denote the minimum and maximum values of the first signal a, respectively. In FIG. 14, the symbols b1 and b2 denote the minimum and maximum values of the second signal b, respectively.

There is a case where the reflectance of the metal layer 69 is lower than that of the dielectric layer 68 and the structure 61 at the wavelength of the detection light beam 5, which is dependent on the material of the wafer 1. In this case, the change of the first and second signals a and b are as follows.

While the dielectric layer 68 is not exposed from the metal layer 69 after the start of the polishing process, the detection light beam 5 is reflected specularly by the mirror-like surface of the metal layer 69 having a low reflectance. Therefore, the first electric signal a has a small value, which is kept approximately constant. At this stage, the scattered/diffracted light beam 10 is scarcely generated because the metal layer 69 has a flat and mirror-like surface and therefore, the second electric signal b has an extremely small value, which is approximately equal to zero.

Subsequently, after the dielectric layer 69 begins to be exposed from the metal layer 68, in other words, after the metal layer 69 becomes extremely thin to allow the light beam 5 to penetrate through the metal layer 69, a part of the detection light beam 5 is reflected specularly by the thin metal layer 69 and another part of the detection light beam 5 is reflected specularly by the underlying structure 61 through the thin metal layer 69 and the transparent dielectric layer 68, forming the specular-reflected light beam 7 to be received by the first photodiode 9. As the dielectric layer 68 is exposed and the metallic wiring lines 65 are formed, the amount of the part of the light beam 5 reflected specularly by the thin metal layer 69 is decreased while the amount of the part of the light beam 5 reflected specularly to the structure 61 is increased.

At the same time, still another part of the detection light beam 5 is scattered or diffracted by the wiring lines 65 and the underlying structure 61, forming the diffracted/scattered light beam 10 to be received by the second photodiode 12. As the dielectric layer 68 is exposed and the wiring lines 65 are formed, the amount of the part of the light beam 5 scattered or diffracted by the wiring lines 65 and the structure 61 is decreased.

Accordingly, after the dielectric layer 69 begins to be exposed from the metal layer 68, it is seen that the first electric signal a is increased, decreased, or kept unchanged while the second electric signal b is increased.

If the increment of the part of the light beam 5 reflected specularly by the underlying structure 61 having a high reflectance is greater than the decrement of the part of the beam 5 reflected specularly by the thin metal layer 69, the first signal a increases.

If the increment of the part of the light beam 5 reflected specularly by the underlying structure 61 having a high reflectance is less than the decrement of the part of the beam 5 reflected specularly by the thin metal layer 69, the first signal a decreases.

If the increment of the part of the light beam 5 reflected specularly by the underlying structure 61 having a high reflectance is equal to the decrement of the part of the beam 5 reflected specularly by the thin metal layer 69, the first signal a is kept unchanged.

After the endpoint of the polishing process, i.e., the wiring lines 65 are completely formed, as shown in FIG. 3C, the surface-area ratio of the completed wiring lines 65 and the exposed dielectric layer 68 does not change even if the polishing process is further advanced. Thus, the first and second signals a and b are kept approximately constant.

As a result, the correct endpoint of the polishing process is determined as the time when the level of the first electric signal a for the specular-reflected light beam 7 is lower or greater than its threshold value, which is dependent on the material of the wafer 1. Alternately, the correct endpoint is determined as the time when the level of the second electric signal b for the scattered/diffracted light beam 10 is higher than its threshold value. Moreover, the correct endpoint may be determined as the time when both the first and second signals a and b satisfy these two conditions, respectively.

There is another case where the scattered/diffracted light beam 10 is generated from the start of the polishing process, which is dependent on the material and the thickness of the metal layer 68. In this case, although the change of the first signal a is the same as shown in FIG. 13, the change of the second signal b is different from FIG. 14. The change of the second signal b is as follows.

If the reflectance of the underlying structure 61 is low and the total reflectance of the wafer 1 is decreased as the polishing process is advanced, and therefore, the increment of the scattered/diffracted light beam 10 due to the increase of the ratio of the scattered/diffracted light beam 10 is less than the decrease of the total reflectance of the wafer 1, the amount of the scattered/diffracted light beam 10 exhibits a large value at the beginning of the polishing process and then, it is lowered with the decreasing specular-reflected beam 7 according to the advance of the polishing process. As a result, in this case, the scattered/diffracted light beam 10 exhibits a similar change to the specular-reflected beam 7 shown in FIG. 13.

As a result, in this case, the correct endpoint of the polishing process is determined as the time when the level of the first electric signal a for the specular-reflected light beam 7 is lower than its threshold value. Alternatively, the correct endpoint is determined as the time when the level of the second electric signal b for the scattered/diffracted light beam 10 is lower than its threshold value. Moreover, the correct endpoint may be determined as the time when both the first and second signals a and b satisfy these two conditions, respectively.

There are still another case where the density of the metal wiring lines 65 on the entire wafer 1 is extremely low. In this case, the change of the second electric signal b is small, because a small amount of the scattered/diffracted light beam 10 will be generated. In this case, therefore, the progress of the polishing process is monitored by the change of the first electric signal a for the specular-reflected light beam 7.

As a result, in this case, the correct endpoint of the polishing process is determined as the time when the level of the first electric signal a for the specular-reflected light beam 7 is lower or greater than its threshold value.

As explained above, the averaged or mean values of the first electric signal a for the specular-reflected light beam 7 and the second electric signal b for the scattered/diffracted light beam 10 are increased or decreased with the progress of the polishing process. Also, any one of the averaged or mean values of the first and second signals a and b may exhibit approximately no change.

With the endpoint detection method according to the eighth embodiment of FIG. 12, even if the wafer 1 has a property that one of the averaged or mean values of the first and second signals a and b exhibits approximately no change, correct endpoint detection can be realized for the wafer 1 of this sort.

Additionally, there is a case where the entire polishing surface of the wafer 1 is not uniformly polished and some unevenness (especially, unevenness directed along the radius of the wafer 1) is generated on the polishing surface. In this case, even if the endpoint is determined according to one of the above-described methods, the polishing process may be insufficient at an area or part of the wafer 1. To prevent this case from occurring, it is preferred that the endpoint is determined at a time after some time delay from the time that is determined according to one of the above-described methods.

As explained above in the eighth embodiment, the time-dependent change of the signals a and b is different according to the parameters such as the structure of the wafer 1, the density of the wiring lines 65, and so on. Thus, it is preferred that any one of the above-described endpoint detection conditions is selected and practically used according to the sort of the chips on the wafer 1.

If the closeness/coarseness of the patterns on the wafer 1 is extremely small and therefore, the possible change of the signals a and b is very small, the step 901 of averaging the signals a and b in FIG. 12 may be omitted.

NINTH EMBODIMENT

Figure 15:
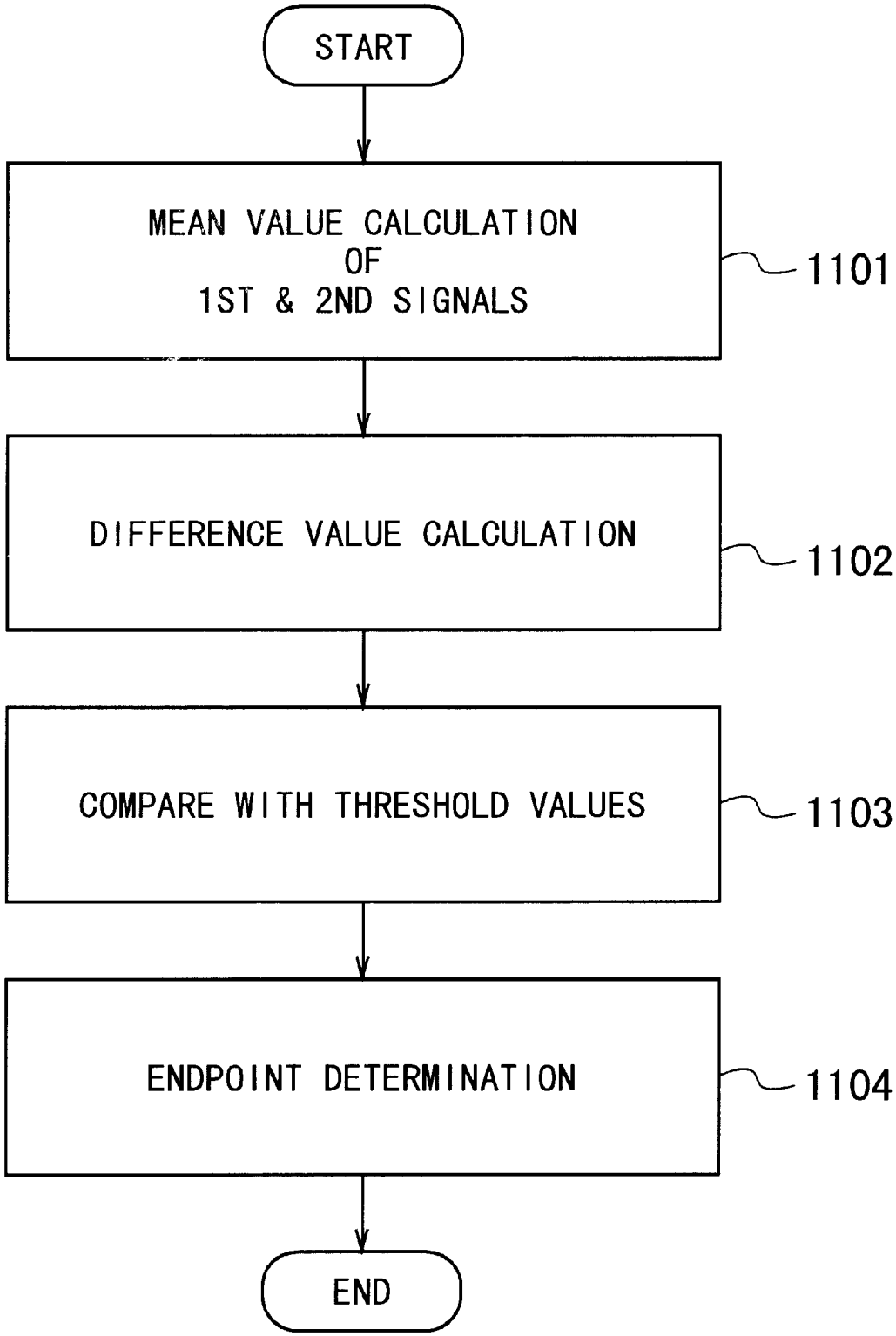
FIG. 15 is a flowchart showing an endpoint detection method of a polishing process according to a ninth embodiment of the present invention, in which the monitoring apparatus according to the first embodiment of FIG. 2 is used.

FIG. 15 shows a flowchart showing an endpoint detection method according to a ninth embodiment of the present invention, which is performed by the monitoring apparatus 51 of FIG. 2 according to the first embodiment.

In the step 1101, a mean or average value of the amount of each of the specular-reflected and scattered/diffracted light beams 7 and 10 (i.e., the first and second electric signals a and b) during each specific time period is calculated.

In the step 1102, reference values for the light beams 7 and 10 are selected from the mean values obtained in the step 1101. The reference values are ones at the time after a specific time period has been passed from the start of the polishing process. Then, differences between the mean values and the corresponding reference values are calculated for the light beams and 7 and 10.

In the step 1103, the differences thus calculated in the step 1102 are compared with their specific threshold values.

In the step 1104, the time when at least one of the differences of the two light beams 7 and 10 is higher or lower than their threshold values is determined as an endpoint of the polishing process.

The endpoint detection method according to the ninth embodiment of FIG. 15 is preferably applied to the monitoring apparatuses according to the first to fifth and seventh embodiment.

In the endpoint detection method according to the ninth embodiment of FIG. 15, unlike the method according to the eighth embodiment of FIG. 12 where the average values of the beams 7 and 10 are directly compared with their threshold values, the reference values for the beams 7 and 10 are selected from the mean values obtained in the step 1101 at the time after the specific time period has been passed from the start of the polishing process. Then, the differences from the reference values calculated in the step 1102 are compared with their threshold values in the step 1103. As a result, this method is effective to the case where the wafers 1 to be polished have different absolute values (or, large fluctuation) of the amount of the specular-reflected beam 7.

The specific time period from the start of the polishing process may be zero. In this case, the average or mean values obtained immediately after the start of the polishing process are used as the reference values.

In the step 1102, ratios between the mean values and the corresponding reference values may be calculated for the light beams and 7 and 10, instead of the differences between the mean values and the corresponding reference values.

If the amount of the specular-reflected light beam 7 is increased after the start of the polishing process due to smoothing of the surface of the metal layer 69, the relative maximum value occurring first from the start of the polishing process may be used as the reference values.

TENTH EMBODIMENT

Figure 16:
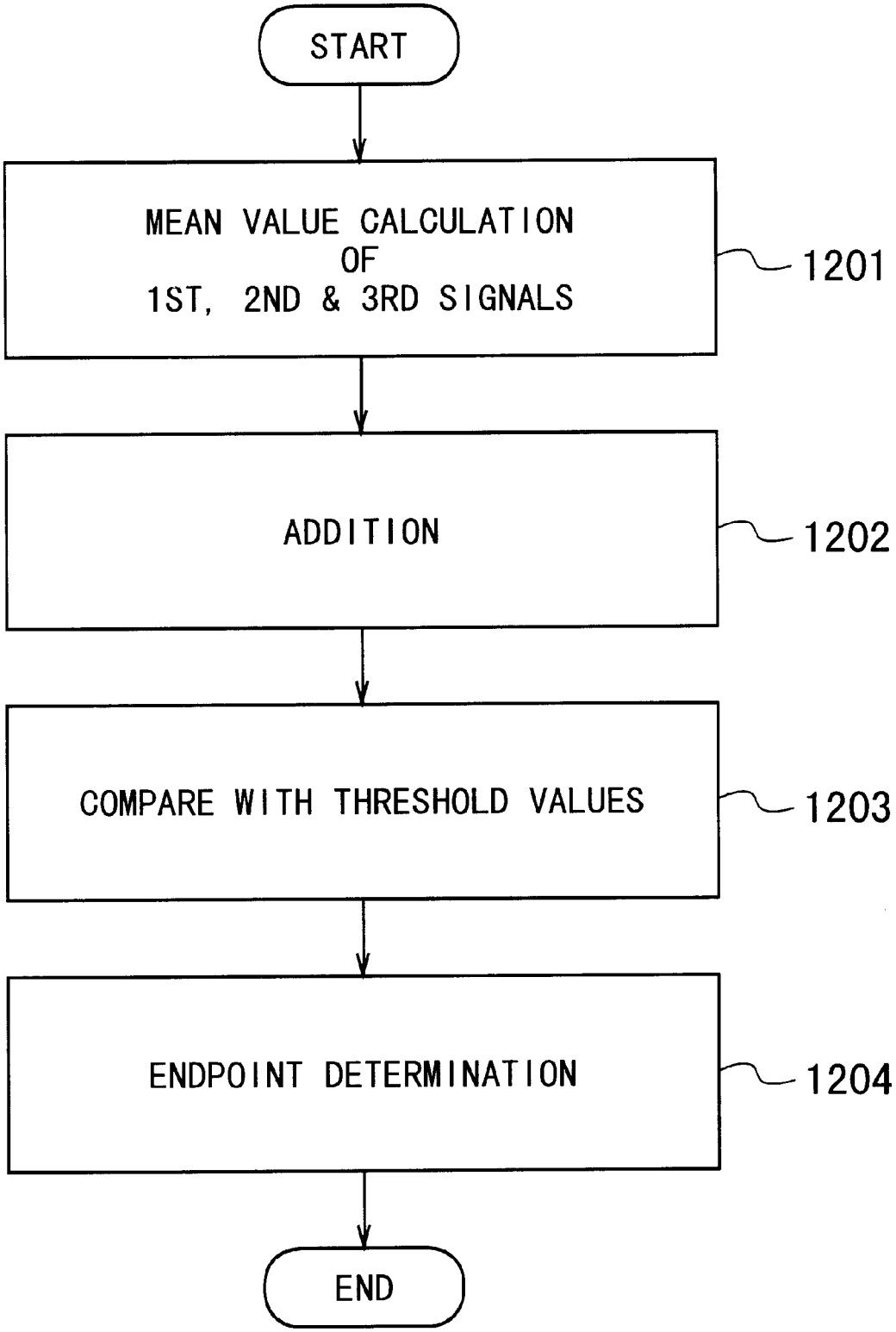
FIG. 16 is a flowchart showing an endpoint detection method of a polishing process according to a tenth embodiment of the present invention, in which the monitoring apparatus according to the first embodiment of FIG. 2 is used.

FIG. 16 shows a flowchart showing an endpoint detection method according to a tenth embodiment of the present invention, which is performed by the monitoring apparatus 51B of FIG. 5 according to the third embodiment.

In the step 1201, a mean or average value of the amount of each of the specular-reflected beam 7 and the scattered diffracted light beams 10*a* and 10*b* (i.e., the first, second, and third electric signals c, d, and e) during each specific time period is calculated.

In the step 1202, the mean or average values of the scattered/diffracted light beams 10*a* and 10*b* are added to each other, resulting in the mean value of the total scattered/diffracted light beam.

In the step 1203, the calculated mean values for the scattered/diffracted light beam 7 and the total scattered/diffracted light beam 10*a* and 10*b* are compared with their specific threshold values, respectively.

In the step 1204, the time when at least one of the mean values for the light beam 7 and the light beams 10*a* and 10*b* is higher or lower than their threshold values is determined as an endpoint of the polishing process.

The endpoint detection method according to the tenth embodiment of FIG. 16 is preferably applied to the monitoring apparatuses according to the third to fifth and seventh embodiments.

The addition in the step 1202 is carried out using software. However, it may be carried out using hardware such as an adder circuit.

ELEVENTH EMBODIMENT

Figure 17:
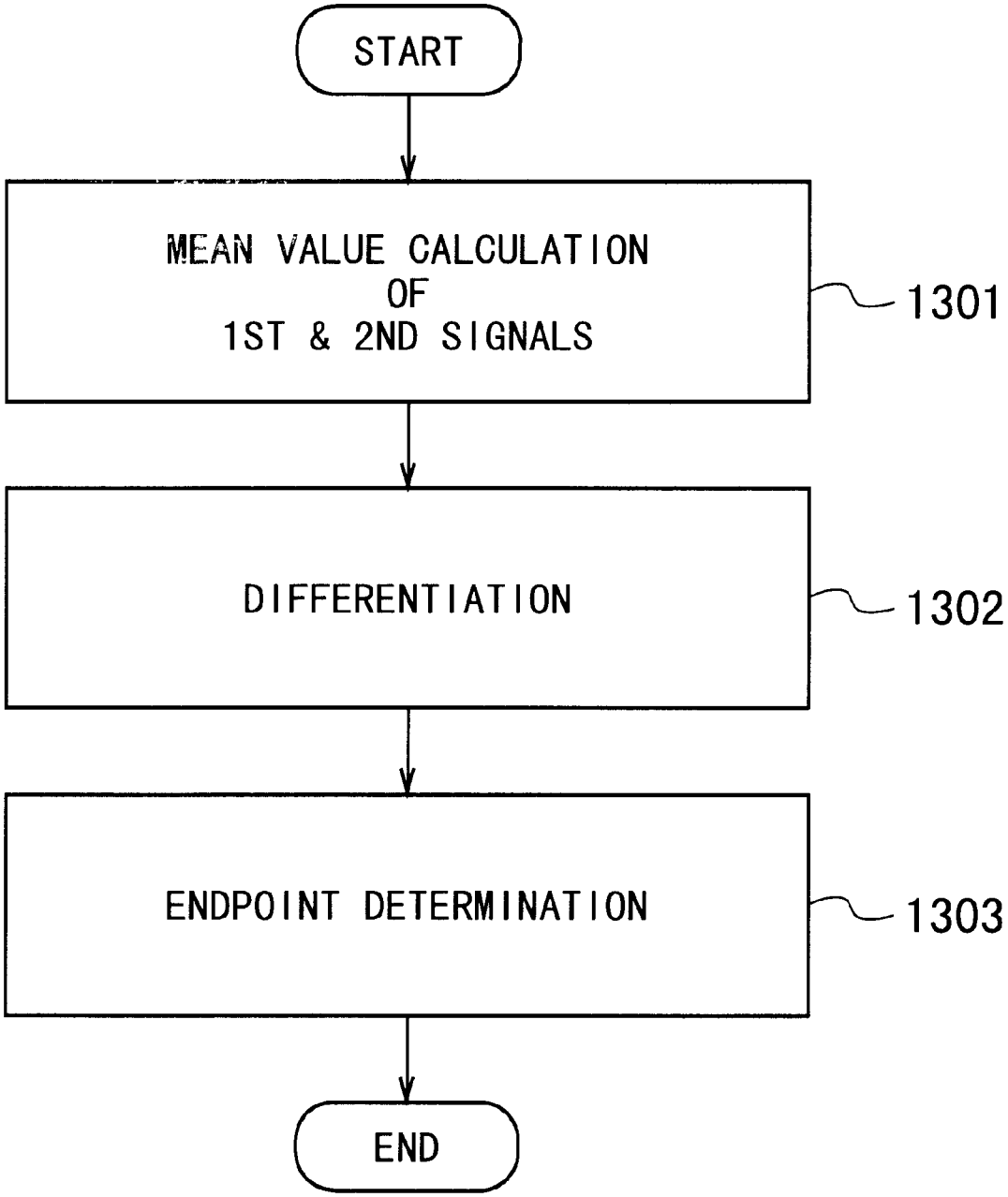
FIG. 17 is a flowchart showing an endpoint detection method of a polishing process according to an eleventh embodiment of the present invention, in which the monitoring apparatus according to the first embodiment of FIG. 2 is used.

FIG. 17 shows a flowchart showing an endpoint detection method according to an eleventh embodiment of the present invention, which is carried out in the steps 1301 to 1303.

In the step 1301, a mean or average value of the amount of each of the specular-reflected and scattered/diffracted light beams 7 and 10 (i.e., the first and second electric signals a and b) during a specific time period is calculated.

In the step 1302, the calculated mean values for the beams 7 and 10 are differentiated by time, resulting in the differentiated values.

In the step 1303, the time when at least one of the differentiated values for the light beams 7 and 10 is equal to or lower than their specific values is determined as an endpoint of the polishing process.

In the step 1302, the differentiated values may be derived not only from adjoining two ones of the mean values but also from the gradient obtained by using the least squares method among the mean values. In the latter case, the endpoint detection is more difficult to be affected by the low-frequency noises while the determination of the endpoint is slightly delayed.

The endpoint detection method according to the eleventh embodiment is preferably used in the monitoring apparatuses according to the first to fifth and seventh embodiments.

As described above, with the endpoint direction method according to the eleventh embodiment, unlike the methods according to the eight to tenth embodiments where the mean values are compared with their threshold values, the endpoint determination is carried out by using the change or variation of the mean values during each time period.

As previously explained in the eighth embodiment of FIG. 12, although the mean values of the first and second signals a and b vary after the dielectric layer 68 begins to be exposed from the metal layer 69, they scarcely exhibit any change after the endpoint. Therefore, the differentiated values of the mean values are comparatively large after the dielectric layer 68 begins to be exposed from the metal layer 69 and then, they are approximately zero after the endpoint.

As a result, in the endpoint detection method according to the eleventh embodiment, the endpoint is determined as the time when the absolute values of the differentiated values are equal to or less than a sufficiently small specific value.

TWELFTH EMBODIMENT

Figure 18:
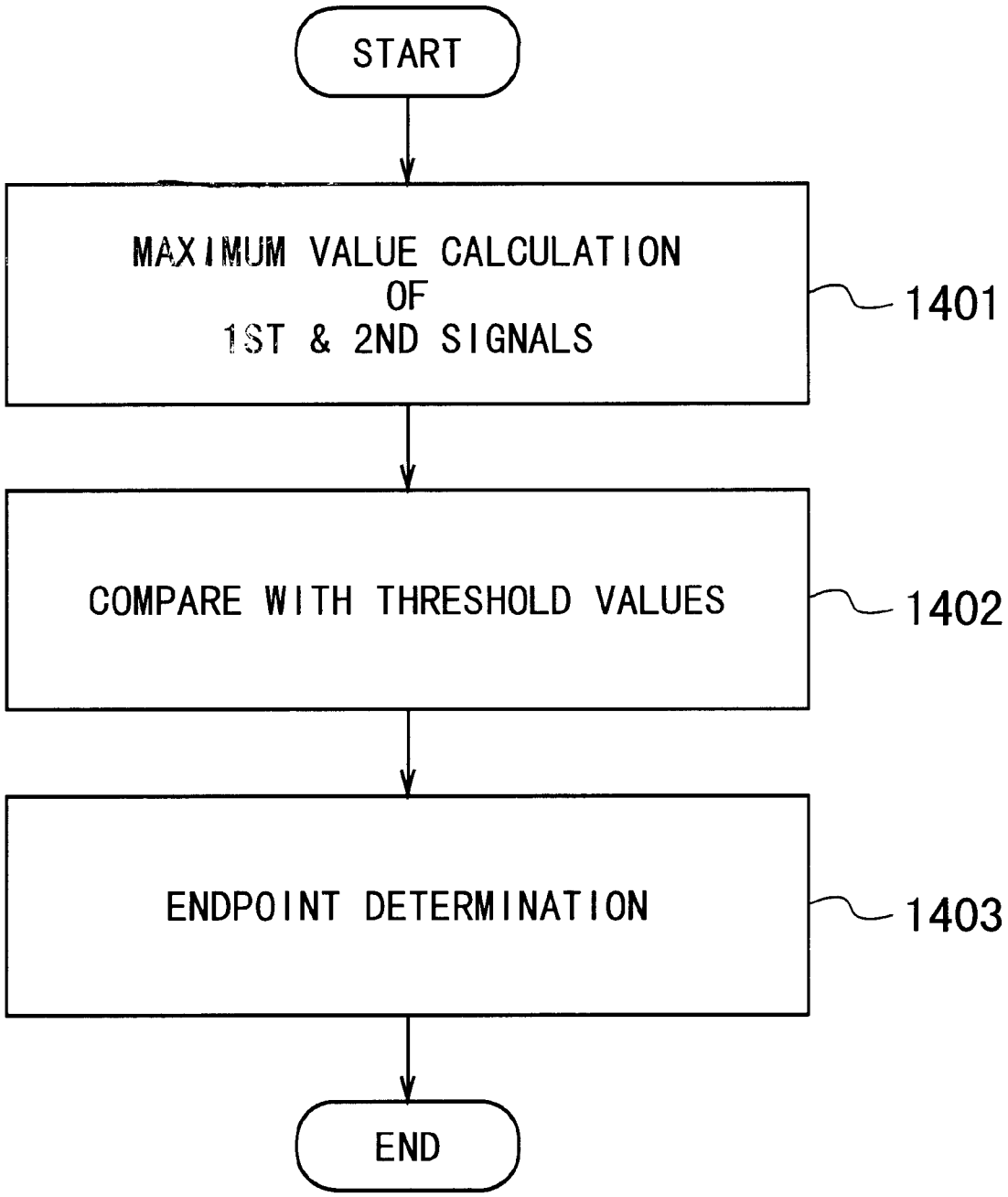
FIG. 18 is a flowchart showing an endpoint detection method of a polishing process according to a twelfth embodiment of the present invention, in which the monitoring apparatus according to the first embodiment of FIG. 2 is used.

FIG. 18 shows a flowchart showing an endpoint detection method according to a twelfth embodiment of the present invention, which is carried out in the steps 1401 to 1403.

In the step 1401, a maximum value of the amount of each of the specular-reflected and scattered/diffracted light beams 7 and 10 (i.e., the first and second electric signals a and b) during a specific time period is calculated.

In the step 1402, the calculated maximum values for the beams 7 and 10 are compared with their threshold values, resulting in the differentiated values.

In the step 1403, the time when at least one of the maximum values for the light beams 7 and 10 is greater or lower than their threshold values is determined as an endpoint of the polishing process.

The endpoint detection method according to the twelfth embodiment is preferably used in the monitoring apparatuses according to the first to fifth and seventh embodiments.

With the endpoint detection method according to the twelfth embodiment, unlike the methods according to the eighth to tenth embodiments where the mean values are compared with their threshold values, the endpoint determination is carried out by comparing the maximum values with the threshold values during each time period, in other words, the endpoint determination is carried out by comparing the change of the maximum values, not the mean values.

THIRTEENTH EMBODIMENT

Figure 19:
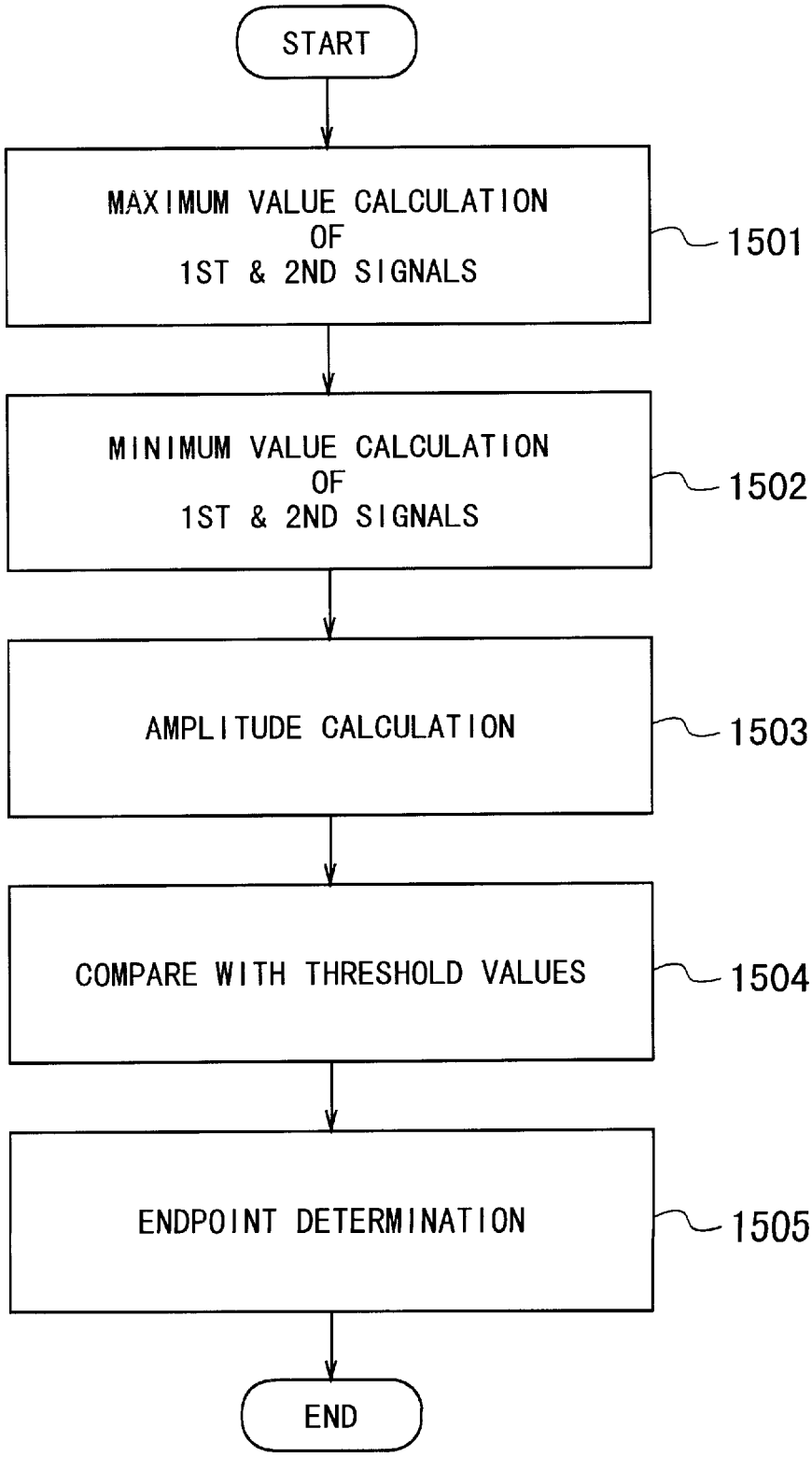
FIG. 19 is a flowchart showing an endpoint detection method of a polishing process according to a thirteenth embodiment of the present invention, in which the monitoring apparatus according to the first embodiment of FIG. 2 is used.

FIG. 19 shows a flowchart showing an endpoint detection method according to a thirteenth embodiment of the present invention, which is carried out in the steps 1501 to 1505.

In the step 1501, a maximum value of the amount of each of the specular-reflected and scattered/diffracted light beams 7 and 10 (i.e., the first and second electric signals a and b) during a specific time period is calculated.

In the step 1502, a minimum value of the amount of each of the specular-reflected and scattered/diffracted light beams 7 and 10 (i.e., the signals a and b) during a specific time period is calculated.

In the step 1503, the differences between the maximum and minimum values are calculated, resulting in amplitudes of the beams 7 and 10 (i.e., the signals a and b).

In the step 1504, the calculated amplitudes for the beams 7 and 10 are compared with their threshold values.

In the step 1505, the time when at least one of the amplitudes for the light beams 7 and 10 is greater than their threshold values is determined as an endpoint of the polishing process.

The endpoint detection method according to the thirteenth embodiment is preferably used in the monitoring apparatuses according to the first to fifth and seventh embodiments.

When the wiring lines 65 begin to be formed, the scattered/diffracted light beam 10 is generated and at the same time, the non-uniform distribution (i.e., closeness/coarseness) of the areas having different reflectance values occurs. This means that the amplitude of the scattered/diffracted light beam 10 increases according to the formation of the wiring lines 65. To cope with this property, with the endpoint detection method according to the thirteenth embodiment, the endpoint determination is carried out by comparing the amplitudes of the specular-reflected and scattered/diffracted light beams 7 and 10 with their threshold values.

FOURTEENTH EMBODIMENT

Figure 20:
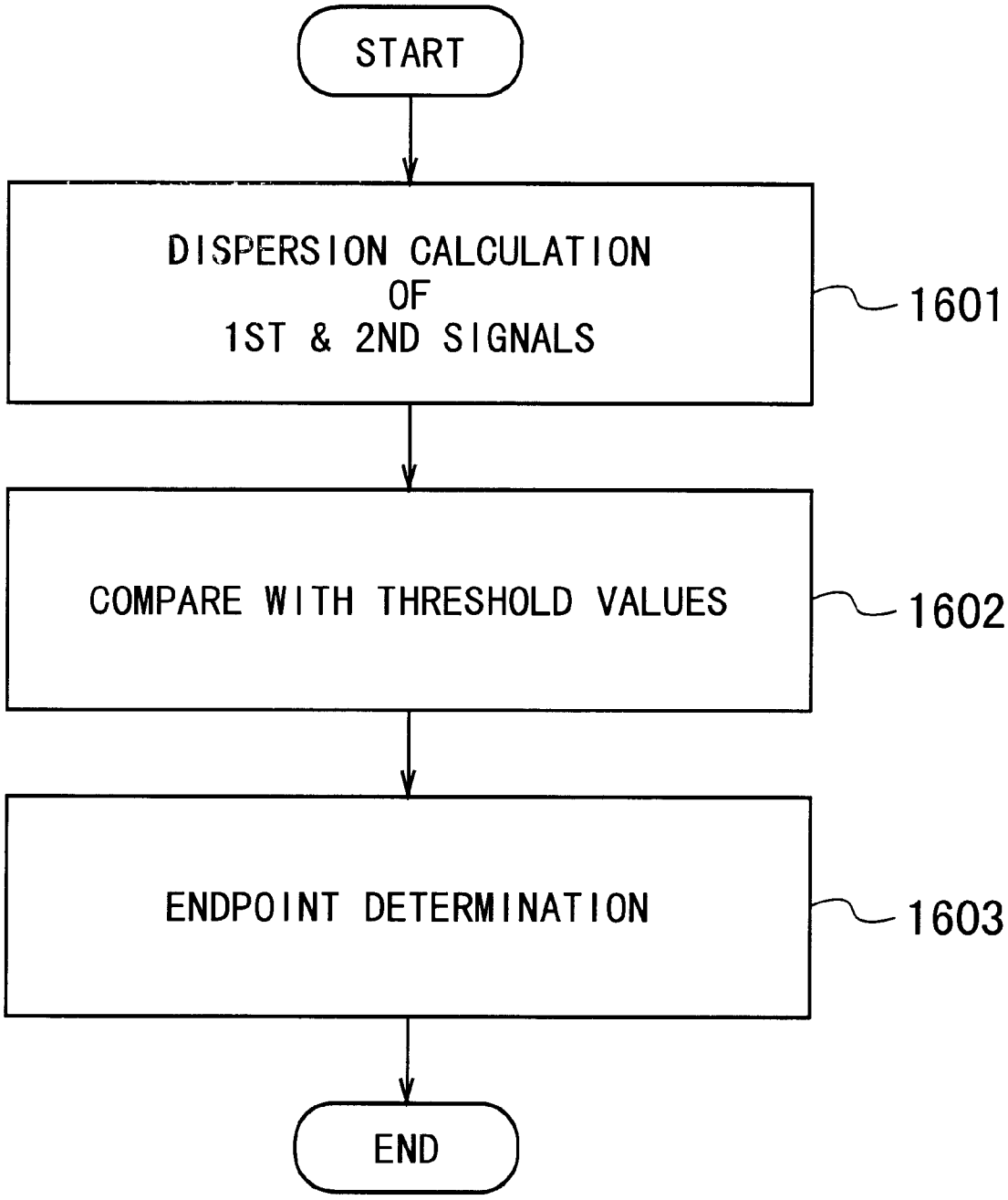
FIG. 20 is a flowchart showing an endpoint detection method of a polishing process according to a fourteenth embodiment of the present invention, in which the monitoring apparatus according to the first embodiment of FIG. 2 is used.

FIG. 20 shows a flowchart showing an endpoint detection method according to a fourteenth embodiment of the present invention, which is carried out in the steps 1601 to 1603.

In the step 1601, a dispersion of the amount of each of the specular-reflected and scattered/diffracted light beams 7 and 10 (i.e., the first and second electric signals a and b) during a specific time period is calculated.

In the steps 1602, the calculated dispersions for the beams 7 and 10 are compared with their threshold values.

In the step 1603, the time when at least one of the dispersions for the light beams 7 and 10 is greater than their threshold values is determined as an endpoint of the polishing process.

The endpoint detection method according to the fourteenth embodiment is preferably used in the monitoring apparatuses according to the first to fifth and seventh embodiments.

As explained in the method according to the thirteenth embodiment of FIG. 19, when the wiring lines 65 begin to be formed, the amplitudes of the specular-reflected and scattered/diffracted light beams 7 and 10 increase according to the formation of the wiring lines 65, in other words, the fluctuations of the beams 7 and 10 become large. Thus, the dispersions of the beams 7 and 10 during each time period increase according to the formation of the wiring lines 65.

To cope with this property, with the endpoint detection method according to the fourteenth embodiment, the endpoint determination is carried out by comparing the dispersions (instead of the amplitudes in FIG. 19) of the specular-reflected and scattered/diffracted light beams 7 and 10 with their threshold values.

FIFTEENTH EMBODIMENT

Figure 22:
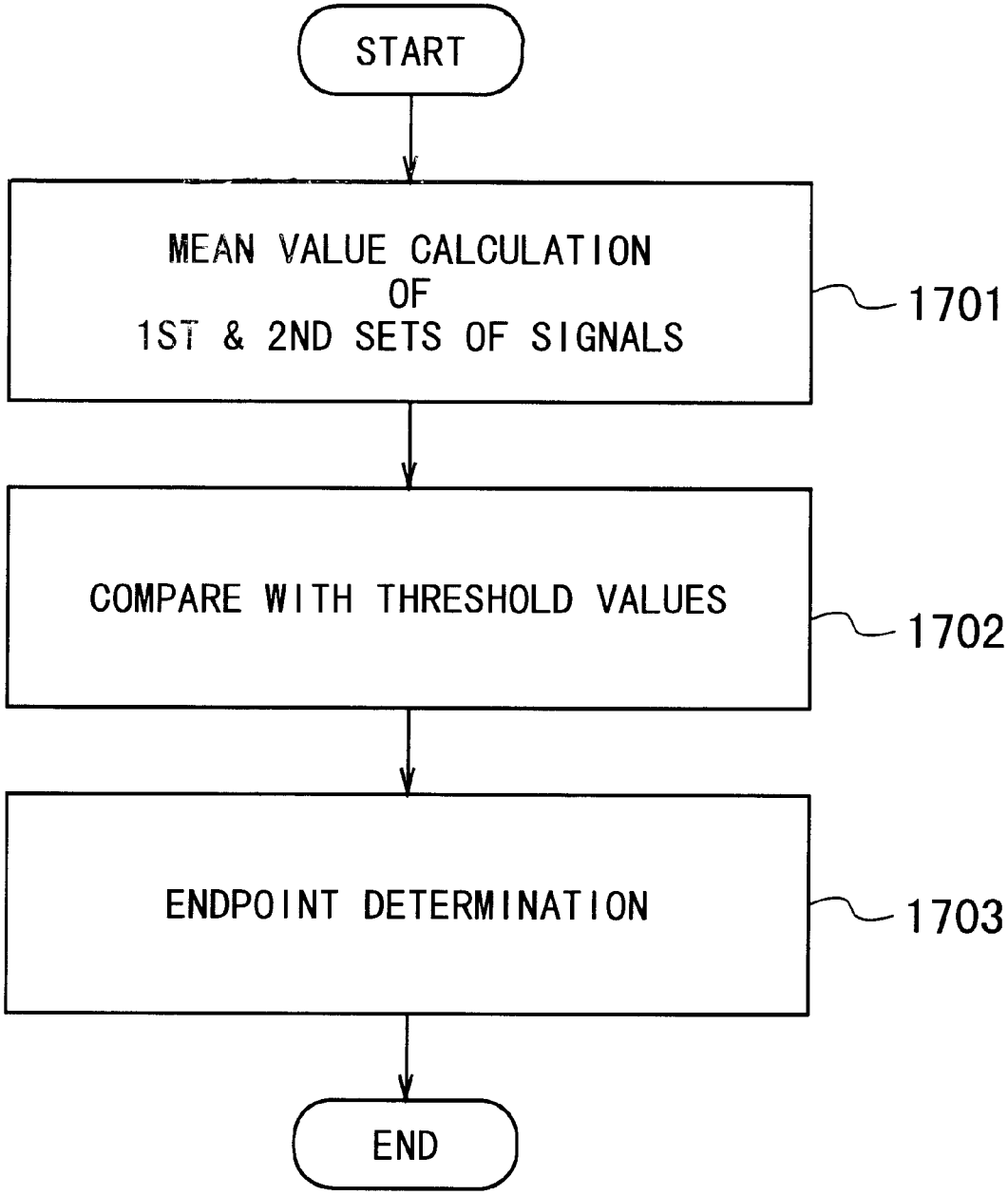
FIG. 22 is a flowchart showing an endpoint detection method of a polishing process according to a fifteenth embodiment of the present invention, in which the monitoring apparatus according to the sixth embodiment of FIG. 8 is used.

FIG. 22 shows a flowchart showing an endpoint detection method according to a fifteenth embodiment of the present invention, which is carried out in the steps 1701 to 1703.

In the step 1701, mean or average values of the amounts of the specular-reflected light beams 7 having different two wavelengths (i.e., the first and second sets of electric signals f and g) during a specific time period were calculated.

In the step 1702, the calculated mean values for the beams 7 are compared with their specific threshold values, respectively.

In the step 1703, the time when the mean values for the light beams 7 at at least one of the two different wavelengths are higher or lower than their threshold values is determined as an endpoint of the polishing process.

The endpoint detection method according to the fifteenth embodiment is preferably used in the monitoring apparatus according to the sixth embodiment of FIG. 8.

As previously explained in the sixth embodiment, when the reflectance difference of the metal layer 69 from the dielectric layer 68 and the underlying structure 61 is small, satisfactorily large change of the signals a and b may be unable to be derived by using the detection light beam 5 of a single wavelength. The endpoint detection method according to the fifteenth embodiment can cope with this case.

SIXTEENTH EMBODIMENT

Figure 23:
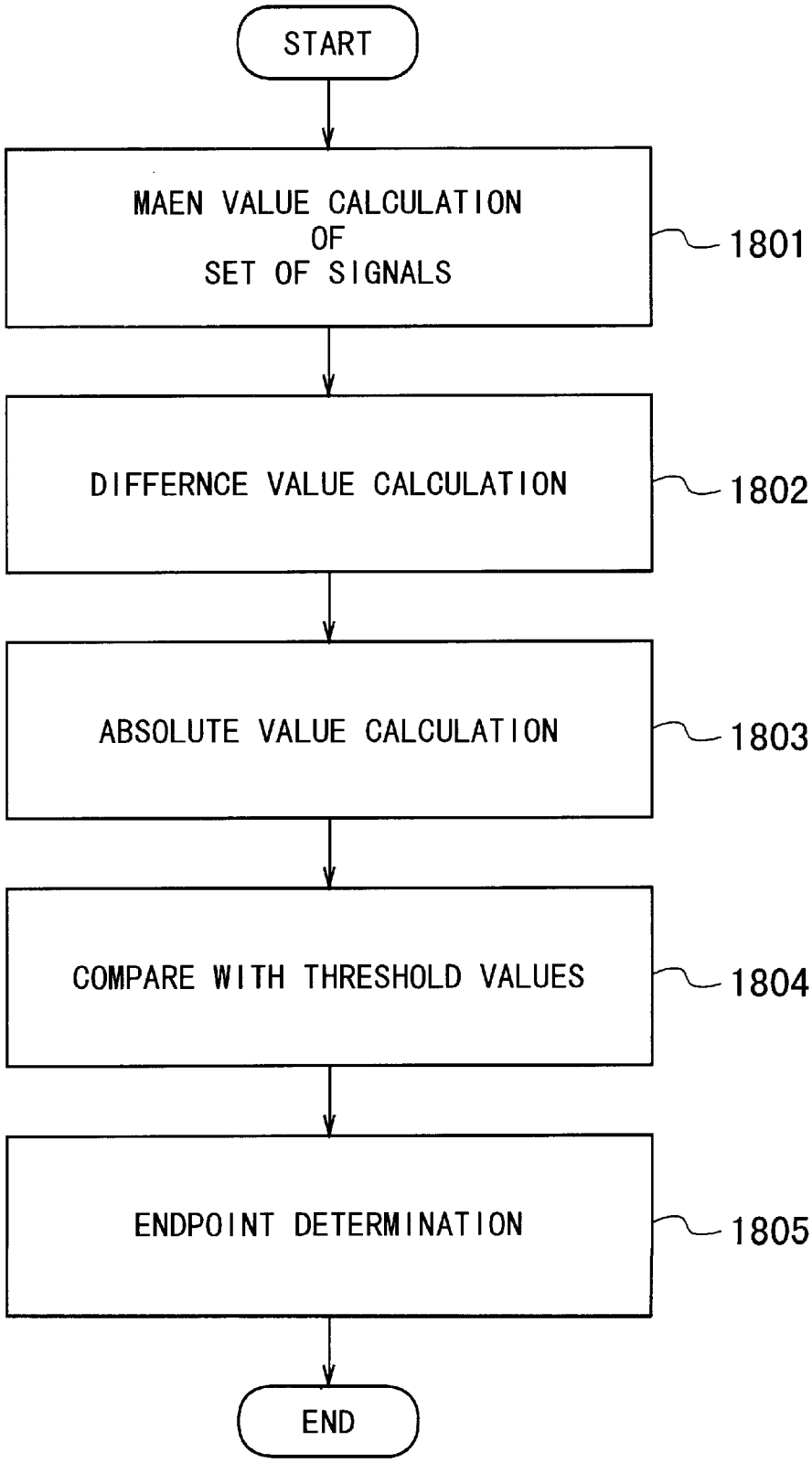
FIG. 23 is a flowchart showing an endpoint detection method of a polishing process according to a sixteenth embodiment of the present invention, in which the monitoring apparatus according to the sixth embodiment of FIG. 8 is used.

FIG. 23 shows a flowchart showing an endpoint detection method according to a sixteenth embodiment of the present invention, which is carried out in the steps 1801 to 1805.

In the step 1801, mean or average values of the amounts of the specular-reflected light beam 7 at the different wavelengths (i.e., the set of electric signals f and g) during a specific time period are calculated.

In the step 1802, reference values for the light beam 7 are selected from the mean values obtained 1801. The reference values are ones at the time after a specific time period has been passed from the start of the polishing process. Then, differences between the mean values and the corresponding reference values are calculated as the variation for the light beam 7 at the different wavelengths.

In the step 1803, the absolute values of the difference or variation thus calculated in the step 1802 are calculated as detected values.

In the step 1804, the detected values are compared with their specific threshold values.

In the step 1805, the time when the detected values for the light beam 7 at at least one of the different wavelengths are higher or lower than their threshold values is determined as an endpoint of the polishing process.

The endpoint detection method according to the sixteenth embodiment is preferably used in the monitoring apparatus according to the sixth embodiment of FIG. 9.

The endpoint detection method is explained in more detail below.

In the step 1801, the first and second electric signals f and g are averaged during the specific time period, resulting in the averaged or mean values. In the step 1802, the variation of the averaged values are calculated by subtraction between the mean values and the corresponding reference values at the time after a specific time period has been passed from the start of the polishing process. The variations exhibit the changes of the specular-reflectance beam 7 at the two different wavelengths.

The wavelength of the first detection light beam 28 is selected so that the reflectance at the metal layer 69 is greater than those of the underlying dielectric layer 68 and the structure 61. Therefore, the variation of the beam 20 has negative values after the dielectric layer 68 is exposed. On the other hand, the wavelength of the second detection light beam 30 is selected so that the reflectance at the metal layer 69 is less than those of the underlying dielectric layer 68 and the structure 61. Therefore, the variation of the beam 30 has positive values after the dielectric layer 68 is exposed.

In the step 1803, the absolute value of the difference of the variations is calculated as the detected values. Since the detection values are equal to the difference between the negative values of the beam 28 and the positive values of the beam 30, the resultant detected values can be increased.

In the step 1804, the resultant detected values are compared with their threshold values.

In the step 1805, the time when the detected values for the light beam 7 at at least one of the different wavelengths are higher or lower than their threshold values is determined as an endpoint of the polishing process.

As described above, the endpoint detection method according to the sixteenth embodiment of FIG. 23 is effective for the case where the change of the amount of the specular-reflected beam 7 at the different wavelengths is small.

If the specific time period from the start of the polishing operation is zero, the mean values obtained first after the start of the process are used as the reference values.

Instead of the "difference" calculated in the step 1802, a "ratio" may be used.

If the amount of the specular-reflected beam 7 increases due to smoothing of the polishing surface of the wafer 1, a first relative maximum value may be used as the reference value.

SEVENTEENTH EMBODIMENT

Figure 25:
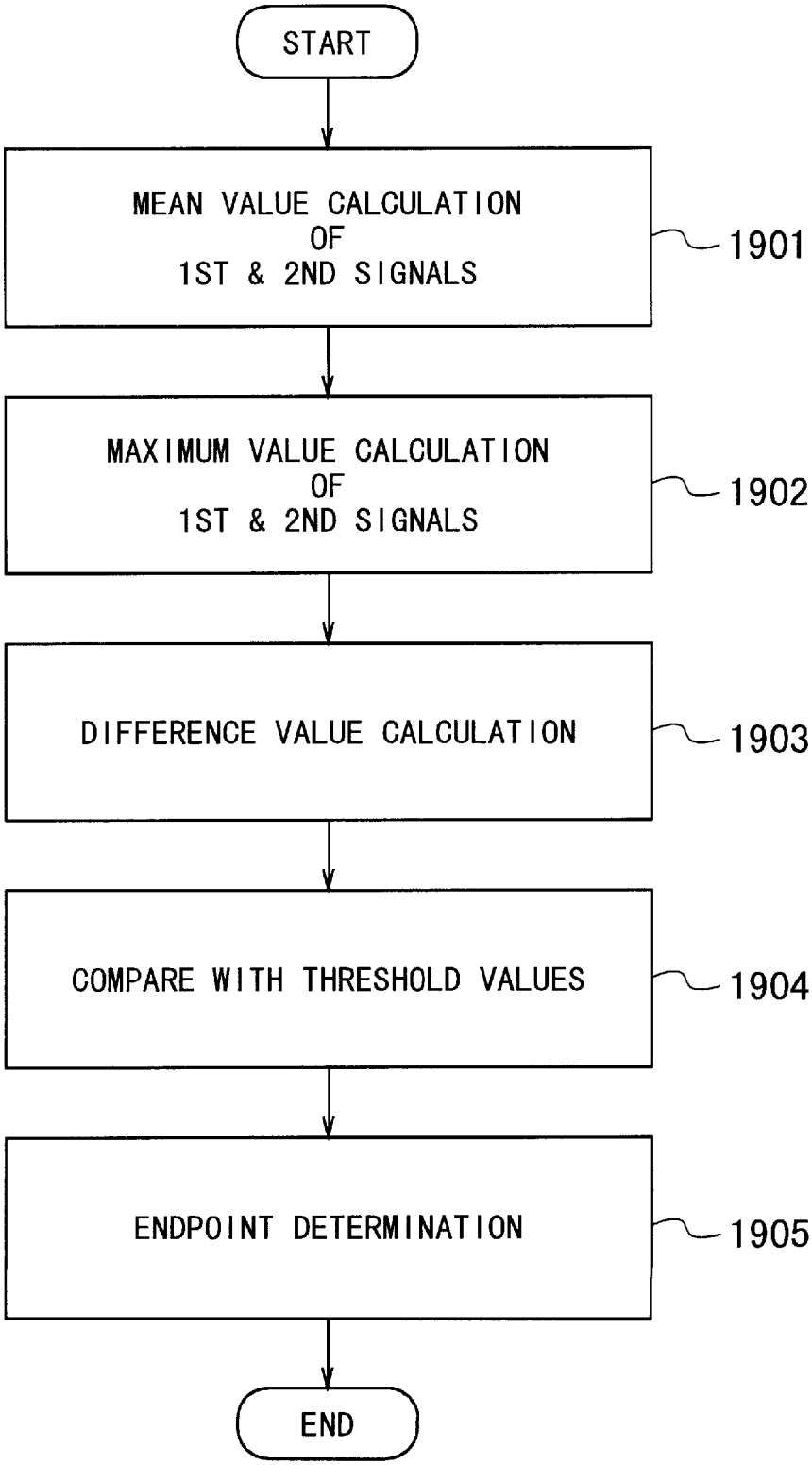
FIG. 25 is a flowchart showing an endpoint detection method of a polishing process according to a seventeenth embodiment of the present invention, in which the monitoring apparatus according to the seventh embodiment of FIG. 10 is used.

FIG. 25 shows a flowchart showing an endpoint detection method according to a seventeenth embodiment of the present invention, which is carried out in the steps 1901 to 1905.

In the step 1901, mean or average values of the amounts of the specular-reflected and scattered/diffracted light beams 7 and 10 (i.e., the first and second electric signals a and b) during a specific time period are calculated.

In the step 1902, maximum values of the amounts of the specular-reflected and scattered/diffracted light beams 7 and 10 (i.e., the signals a and b) during a specific time period are calculated.

In the step 1903, the difference between the mean values and the maximum values are calculated.

In the step 1904, the differences are compared with their specific threshold values.

In the step 1905, the time when the difference values for the light beam 7 and 10 are higher or lower than their threshold values is determined as an endpoint of the polishing process.

The endpoint detection method according to the seventeenth embodiment is preferably used in the monitoring apparatus according to the seventh embodiment of FIG. 10.

In the monitoring method according to the seventh embodiment, after the underlying dielectric layer 68 begins to be exposed from the metal layer 69 due to the progressing polishing process, the level of the first and second electric signals a and b is not changed compared with that obtained before the dielectric layer 68 is entirely covered with the metal layer 69 under the condition that the condensed light beam 5 is reflected by the specific pattern on the wafer 1. However, if the condensed light beam 5 is reflected by any area other than the specific pattern, the level of the first and second signals a and b is changed due to the exposed dielectric layer 68. Accordingly, the maximum value of the signals a and b exhibits substantially no change while the minimum value of the signals a and b exhibits significant change, resulting in significant change of the mean or average value during the specific time period. The endpoint detection method according to the seventeenth embodiment of FIG. 25 is able to cope with this case.

In the step 1903, instead of the "difference" between the mean value and the maximum value, a "ratio" between the mean value and the maximum value may be used.

EIGHTEENTH EMBODIMENT

Figure 26:
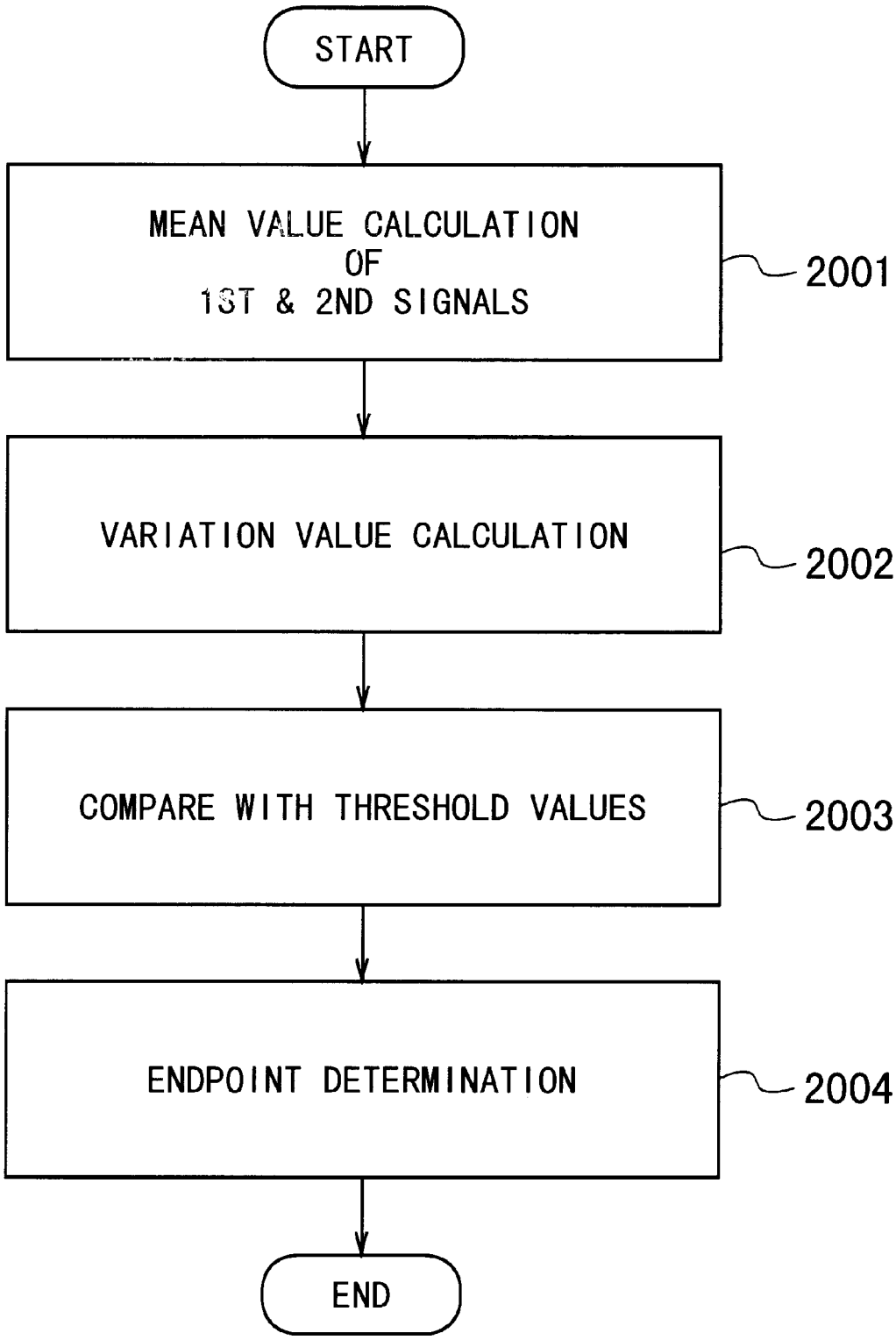
FIG. 26 is a flowchart showing an endpoint detection method of a polishing process according to an eighteenth embodiment of the present invention, in which the monitoring apparatus according to the first embodiment of FIG. 2 is used.

FIG. 26 shows a flowchart showing an endpoint detection method according to an eighteenth embodiment of the present invention, which is carried out in the steps 2001 to 2004.

In the step 2001, mean or average values of the amounts of the specular-reflected and scattered/diffracted light beams 7 and 10 (i.e., the first and second electric signals a and b) during a specific time period are calculated.

In the step 2002, variation values between maximum and minimum values of the mean values during specific preceding time periods are calculated.

In the step 2003, the variation values of the beams are compared with corresponding threshold values.

In the step 2004, the time when at least one of the variation values of the two beams is lower than the corresponding threshold value is determined as an endpoint of the polishing process.

As explained in the endpoint detection method according to the eighth embodiment of FIG. 12, the mean values of the specular-reflected and scattered/diffracted light beams 7 and 10 vary after the dielectric layer 68 is exposed from the metal layer 69. However, they exhibit almost no change after the endpoint. Accordingly, the variation values of the beams 7 and 10 becomes small after the endpoint.

If the adjoining two values in the successive time periods are used for calculating the variation values, the calculation is readily affected by noises, resulting in error detection. Thus, the variation values between maximum and minimum values of the mean values during several preceding time periods are used for this purpose.

NINETEENTH EMBODIMENT

Figure 27:
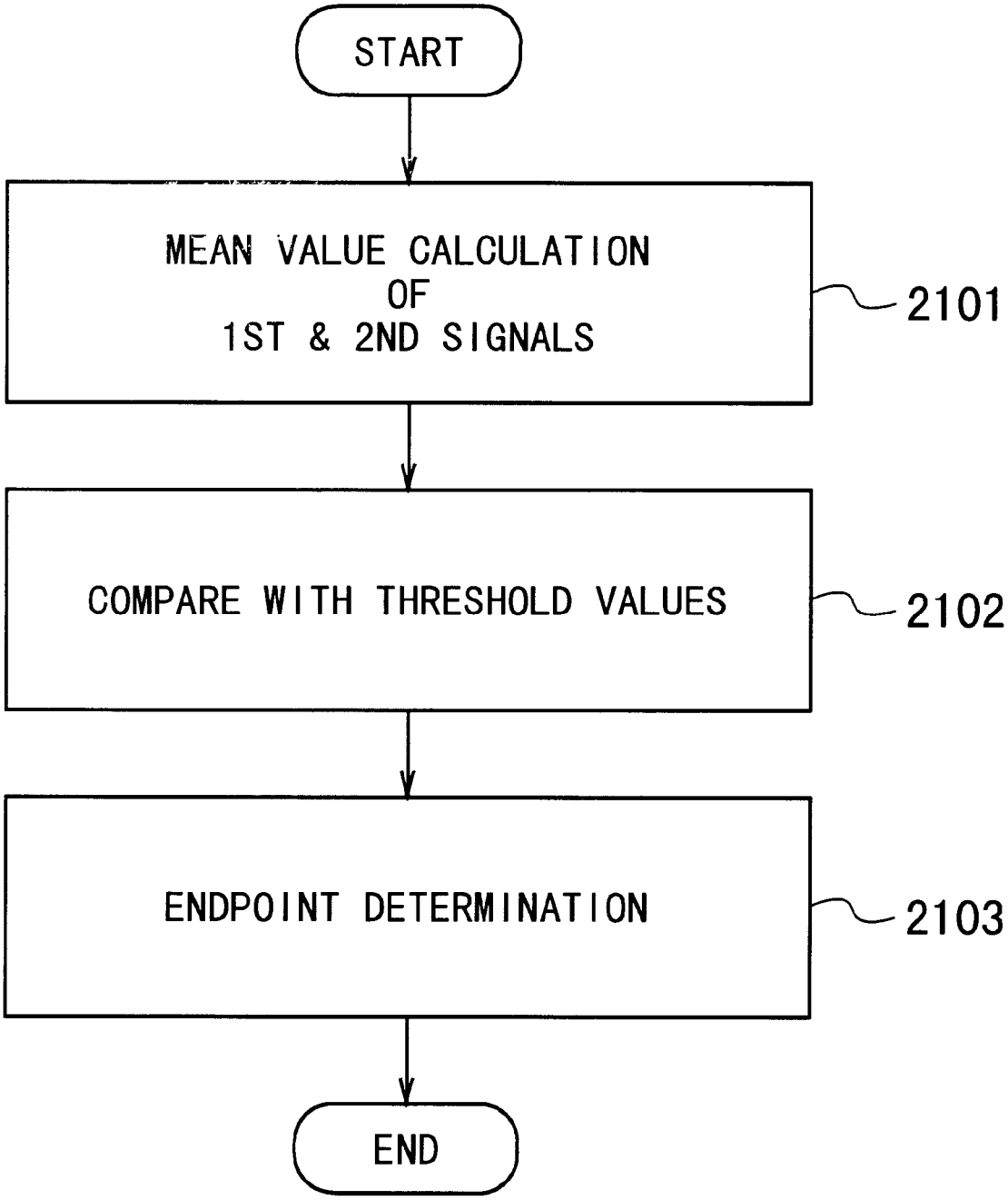
FIG. 27 is a flowchart showing an endpoint detection method of a polishing process according to a nineteenth embodiment of the present invention, in which the monitoring apparatus according to the first embodiment of FIG. 2 is used.

FIG. 27 shows a flowchart showing an endpoint detection method according to a nineteenth embodiment of the present invention, which is carried out in the steps 2101 to 2103.

In the step 2101, mean or average values of the amounts of the specular-reflected and scattered/diffracted light beams 7 and 10 (i.e., the first and second electric signals a and b) during a specific time period are calculated.

In the step 2102, the mean values of the beams 7 and 10 are compared with corresponding threshold values.

In the step 2103, the time when at least one of the mean values of the two beams 7 and 10 is higher or lower than the corresponding threshold values through several consecutive time periods is determined as an endpoint of the polishing process.

The endpoint detection method according to the nineteenth embodiment is preferably used for the monitoring apparatus according to the first to fifth and seventh embodiments.

The method according to the nineteenth embodiment is effective for the case where the first and second electric signals a and b contain high-level noises and therefore, error detection tends to occur.

TWENTIETH EMBODIMENT

In an endpoint detection method according to a twentieth embodiment of the present invention, although not illustrated here, at least two ones of the endpoint detection methods according to the eighth to nineteenth embodiments are selected and then, these selected methods are combined to form a logic sum or logic product.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A polishing process monitoring apparatus comprising:

(a) a light irradiating means for irradiating a detection light beam to a semiconductor wafer;

(b) a first light receiving means for receiving a specular-reflected light beam generated by reflection of said detection light beam at said wafer and for outputting a first signal according to an amount of said specular-reflected light beam;

(c) a second light receiving means for receiving a scattered/diffracted light beam generated by scattering or diffraction of said detection light beam at said wafer and for outputting a second signal according to an amount of said scattered/diffracted light beam; and (d) a monitoring means for monitoring a polishing process of said wafer by using said first and second signals.

2. The apparatus as claimed in claim 1, wherein said monitoring means performs a step of comparing a mean value of said first signal for said specular-reflected light beam in a specific time period with a first threshold value, generating a first comparison result;

a step of comparing a mean value of said second signal for said scattered/diffracted light beam in said specific time period with a second threshold value, generating a second comparison result; and a step of determining a polished state of said wafer based on said first and second comparison results, thereby monitoring said polishing process of said wafer.

3. The apparatus as claimed in claim 1, wherein said monitoring means performs a step of calculating mean values of said first signal for said specular-reflected light beam during a specific time period after start of said polishing process;

a step of selecting one of said mean values of said first signal to define a first reference value;

a step of setting a difference or ratio between a mean value of said first signal and said first reference value in a subsequent specific time period as a first variation value;

a step of calculating mean values of said second signal for said scattered/diffracted light beam during said specific time periods after start of said polishing process;

a step of selecting one of said mean values of said second signal to define a second reference value;

a step of setting a difference or ratio between a mean value of said second signal and said second reference value in said subsequent specific time period as a second variation value;

a step of comparing said first variation value with said first threshold value, generating a first comparison result;

a step of comparing said second variation value with said second threshold value, generating a second comparison result; and a step of determining a polished state of said wafer based on said first and second comparison results, thereby monitoring said polishing process of said wafer.

4. The apparatus as claimed in claim 1, wherein said monitoring means performs a step of comparing a change of a mean value of said first signal for said specular-reflected light beam in a specific time period with a first threshold value, generating a first comparison result;

a step of comparing a change of a mean value of said second signal for said scattered/diffracted light beam in said specific time period with a second threshold value, generating a second comparison result; and a step of determining a polished state of said wafer based on said first and second comparison results, thereby monitoring said polishing process of said wafer.

5. The apparatus as claimed in claim 1, wherein said monitoring means performs a step of comparing a time-derivative of a mean value of said first signal for said specular-reflected light beam in a specific time period with a first threshold value, generating a first comparison result;

a step of comparing a time-derivative of a mean value of said second signal for said scattered/diffracted light beam in said specific time period with a second threshold value, generating a second comparison result; and a step of determining a polished state of said wafer based on said first and second comparison results, thereby monitoring said polishing process of said wafer.

6. The apparatus as claimed in claim 1, wherein said monitoring means performs a step of deriving maximum of said first signal for said specular-reflected light beam in a specific time period;

a step of deriving a maximum of said second signal for said scattered/diffracted light beam in said specific time period;

a step of comparing said maximum of said mean value of said first signal with a first threshold value, generating a first comparison result;

a step of comparing said maximum of said mean value of said second signal with a second threshold value, generating a second comparison result; and a step of determining a polished state of said wafer based on said first and second comparison results, thereby monitoring said polishing process of said wafer.

7. The apparatus as claimed in claim 1, wherein said monitoring means performs a step of deriving an amplitude of said first signal for said specular-reflected light beam in a specific time period;

a step of deriving an amplitude of said second signal for said scattered/diffracted light beam in said specific time period;

a step of comparing said amplitude of said first signal with a first threshold value, generating a first comparison result;

a step of comparing said amplitude of said second signal with a second threshold value, generating a second comparison result; and a step of determining a polished state of said wafer based on said first and second comparison results, thereby monitoring said polishing process of said wafer.

8. The apparatus as claimed in claim 1, wherein said monitoring means performs a step of deriving a dispersion of said first signal for said specular-reflected light beam in a specific time period;

a step of deriving a dispersion of said second signal for said structured/diffracted light beam in said specific time period;

a step of comparing said dispersion of said first signal with a first threshold value, generating a first comparison result;

a step of comparing said dispersion of said second signal with a second threshold value, generating a second comparison result; and a step of determining a polished state of said wafer based on said first and second comparison results, thereby monitoring said polishing process of said wafer.

9. The apparatus as claimed in claim 1, wherein said monitoring means performs a step of deriving a difference or ratio between maximum and mean values of said first signal for said specular-reflected light beam in a specific time period;

a step of deriving a difference or ratio between maximum and mean values of said second signal for said scattered/diffracted light beam in said specific time period;

a step of comparing said difference or ratio of said first signal with a first threshold value, generating a first comparison result;

a step of comparing said difference or ratio of said second signal with a second threshold value, generating a second comparison result; and a step of determining a polished state of said wafer based on said first and second comparison results, thereby monitoring said polishing process of said wafer.

10. The apparatus as claimed in claim 1, wherein said monitoring means performs a step of calculating mean values of said first signal for said specular-reflected light beam during specific time periods after start of said polishing process;

a step of calculating a difference between maximum and minimum values of said mean values of said first signal;

a step of calculating mean values of said second signal for said scattered/diffracted light beam during said specific time periods after start of said polishing process;

a step of calculating a difference between maximum and minimum values of said mean values of said second signal;

a step of comparing said difference of said first signal with a first threshold value, generating a first comparison result;

a step of comparing said difference of said second signal with a second threshold value, generating a second comparison result; and a step of determining a polished state of said wafer based on said first and second comparison results, thereby monitoring said polishing process of said wafer.

11. The apparatus as claimed in claim 1, wherein said monitoring means performs a step of comparing a mean value of said first signal for said specular-reflected light beam in a specific time period with a first threshold value, generating a first comparison result;

a step of comparing a mean value of said second signal for said scattered/diffracted light beam in said specific time period with a second threshold value, generating a second comparison result; and a step of determining a polished state of said wafer based on said first and second comparison results, thereby monitoring said polishing process of said wafer;

wherein said step of determining said polished state of said wafer is carried out using a first number of times when said mean value of said first signal exceeds said first threshold value and a second number of times when said mean value of said second signal exceeds said second threshold value.

12. The apparatus as claimed in claim 1, further comprising a reflector for reflecting said specular-reflected light beam to form a reflected beam of said specular-reflected light beam;

said reflector being located on an optical axis of said specular-reflected light beam;

wherein said first light receiving means receives said reflected beam of said specular-reflected light beam.

13. The apparatus as claimed in claim 1, further comprising an optical condenser for condensing said detection light beam to have a smaller spot size on said wafer than that of a specific pattern on said wafer.

14. The apparatus as claimed in claim 1, further comprising at least one of an optical reflector for reflecting said scattered/diffracted light beam and an optical condenser for condensing said scattered/diffracted light beam;

wherein each of said optical reflector and said optical condenser is located on an optical axis of said specular-reflected light beam at a downstream position with respect to said first light receiving means or a reflector for reflecting said specular-reflected light beam to said first light receiving means.

15. The apparatus as claimed in claim 1, further comprising a slurry removing means for approximately removing a polishing slurry from an irradiated position on said wafer;

wherein said slurry removing means emits a stream of fluid toward said irradiated position or a position apart from said irradiated position along a specific direction by a specific distance.

16. A polishing process monitoring apparatus comprising:

(a) a light irradiating means for irradiating at least one detection light beam having different wavelengths from one another to a semiconductor wafer;

(b) a first light receiving means for receiving at least one specular-reflected light beam generated by reflection of said at least one detection light beams at said wafer and for outputting signals according to an amount of said at least one specular-reflected light beam; and (c) a monitoring means for monitoring a polishing process of said wafer by using said signal.

17. The apparatus as claimed in claim 16, wherein said monitoring means performs a step of comparing mean values of said signals for said specular-reflected light beams in a specific time period with a first threshold value, generating a comparison result; and a step of determining a polished state of said wafer based on said comparison result, thereby monitoring said polishing process of said wafer.

18. The apparatus as claimed in claim 16, wherein said monitoring means performs a step of calculating mean values of said signals for said specular-reflected light beams during a specific time period after start of said polishing process;

a step of defining said mean values of said signals as reference values;

a step of setting a difference or ratio between a mean value of each of said signals and a corresponding one of said reference values in a subsequent specific time period as a variation value;

a step of comparing said variation values of said signals with said corresponding threshold values, generating a comparison result; and a step of determining a polished state of said wafer based on said comparison result, thereby monitoring said polishing process of said wafer.

19. The apparatus as claimed in claim 16, wherein said light irradiating means includes light irradiating elements for irradiating light beams having different wavelengths from one another as said detection light beams, said light irradiating elements being located on different optical axes;

and wherein said light receiving means includes light receiving elements for receiving respectively said specular-reflected light beams to output said signals, said light receiving elements being located on different optical axes.

20. A polishing process monitoring apparatus comprising:

(a) a light irradiating means for irradiating at least two detection light beams having different wavelengths from one another to semiconductor wafer;

(b) a first light receiving means for receiving at least two specular-reflected light beams generated by reflection of said at least two detection light beams at said wafer and for outputting a first signal according to an amount of said at least two specular-reflected light beams;

(c) a second light receiving means for receiving at least two scattered/diffracted light beams generated by scattering or diffraction of said at least two detection light beams at said wafer and for outputting a second signal according to amounts of said at least two scattered/diffracted light beams; and (d) a monitoring means for monitoring a polishing process of said wafer by using said first and second signals.

21. The apparatus as claimed in claim 20, further comprising reflectors for reflecting said specular-reflected light beams to form reflected beams of said specular-reflected light beams;

said reflectors being located on optical axes of said specular-reflected light beams;

wherein said first light receiving means receives said reflected beams of said specular-reflected light beams.

22. The apparatus as claimed in claim 20, further comprising an optical condenser for condensing said detection light beams to have smaller spot sizes on said wafer than that of a specific pattern on said wafer.

23. The apparatus as claimed in claim 20, further comprising at least one of an optical reflector for reflecting said scattered/diffracted light beams and an optical condenser for condensing said scattered/diffracted light beams;

wherein each of said optical reflector and said optical condenser is located at a downstream position with respect to said first light receiving means or a reflector for reflecting said specular-reflected light beams to said first light receiving means.

24. The apparatus as claimed in claim 20, further comprising an irradiating means for irradiating said detection light beams along a same optical axis to said wafer; and a spectrum analyzer for receiving said specular-reflected beams to spectrum-analyze said specular-reflected beams.

25. The apparatus as claimed in claim 20, further comprising a slurry removing means for approximately removing a polishing slurry from an irradiated position on said wafer;

wherein said slurry removing means emits a stream of fluid toward said irradiated position or a position apart from said irradiated position along a specific direction by a specific distance.

26. A polishing process monitoring apparatus comprising:

(a) a light irradiating means for irradiating a detection light beam;

(b) a light condensing means for condensing said detection light beam to form a condensed light beam having a spot size smaller than a specific pattern size on said wafer, said light condensing means being located on an optical axis of said detection light beam;

(c) a light receiving means for receiving a specular-reflected light beam generated by reflection of said condensed light beam at said wafer and for outputting a signal according to an amount of said specular-reflected light beam; and (d) a monitoring means for monitoring a polishing process of said wafer by using the signal.

27. The apparatus as claimed in claim 26, wherein said monitoring means performs a step of deriving a difference or ratio between maximum and mean values of said signal for said specular-reflected light beam in a specific time period;

a step of comparing said difference or ratio of said first signal with a first value, generating a comparison result; and a step of determining a polished state of said wafer based on said comparison result, thereby monitoring said polishing process of said wafer.

28. A polishing machine for a semiconductor wafer, comprising:

a polishing process monitoring apparatus as claimed in one of claims 1 to 27; and a polishing means for polishing said wafer.

29. A polishing process monitoring method comprising the steps of:

(a) irradiating a detection light beam to a semiconductor wafer:

(b) receiving a specular-reflected light beam generated by reflection of said detection light beam at said wafer to output a first signal according to an amount of said specular-reflected light beam;

(c) receiving a scattered/diffracted light beam generated by scattering or diffraction of said detection light beam at said wafer to output a second signal according to an amount of said scattered/diffracted light beam; and (d) processing said first and second signals to produce a resultant signal required for monitoring a polishing process of said wafer.

30. The method as claimed in claim 29, wherein said first signal is outputted according to an amount change of said specular-reflected light beam in said step (b) and said second signal is outputted according to an amount change of said scattered/diffracted light beam in said step (c).

31. A polishing process monitoring method comprising the steps of:

(a) irradiating at least two detection light beams having different wavelengths from one another to a semiconductor wafer;

(b) receiving at least two specular-reflected light beams generated by reflection of said at least two detection light beams at said wafer and for outputting signals according to amounts of said at least two specular-reflected light beams; and (c) processing said signal to produce resultant signals required for monitoring a polishing process of said wafer.

32. A polishing process monitoring method comprising the steps of:

(a) irradiating at least two detection light beams having different wavelengths from one another to a semiconductor wafer;

(b) receiving at least two specular-reflected light beams generated by reflection of said at least two detection light beams at said wafer and for outputting first signals according to amounts of said at least two scattered/diffracted light beams;

(c) receiving at least two scattered/diffracted light beams generated by scattering or diffraction of said at least two detection light beams at said wafer and for outputting second signals according to an amount of said at least two scattered/diffracted light beams; and (d) processing said first and second signals to produce resultant signals required for monitoring a polishing process of said wafer.

33. A polishing process monitoring method comprising the steps of:

(a) irradiating a detection light beam;

(b) condensing said detection light beam to form a condensed light beam having a spot size smaller than a specific pattern size on said wafer;

said light condensing means being located on an optical axis of said detection light beams;

(c) receiving a specular-reflected light beam generated by reflection of said condensed light beam at said wafer and for outputting a first signal according to an amount of said specular-reflected light beam; and (d) processing said first signal to produce a resultant signal required for monitoring a polishing process of said wafer.

34. The method as claimed in claim 33, wherein further comprising a step of (e) receiving a scattered/diffracted light beam generated by scattering or diffraction of said detection light beam at said wafer and for outputting a second signal according to an amount of said scattered/diffracted light beam;

wherein said first and second signals are processed in said step (d) to produce said resultant signal required for monitoring said polishing process of said wafer.

* * * * *